US012577779B2

(12) United States Patent
Marjaba

(10) Patent No.: US 12,577,779 B2
(45) Date of Patent: Mar. 17, 2026

(54) BUILDING CONSTRUCTION SYSTEM

(71) Applicant: Mad Buildings Technologies, Inc., Ottawa (CA)

(72) Inventor: Ghassan Marjaba, Ottawa (CA)

(73) Assignee: Mad Buildings Technologies, Inc., Ottawa (CA)

( * ) Notice: Subject to any disclaimer, the term of this patent is extended or adjusted under 35 U.S.C. 154(b) by 460 days.

(21) Appl. No.: 18/026,290

(22) PCT Filed: Sep. 13, 2021

(86) PCT No.: PCT/CA2021/051268
§ 371 (c)(1),
(2) Date: Mar. 14, 2023

(87) PCT Pub. No.: WO2022/056624
PCT Pub. Date: Mar. 24, 2022

(65) Prior Publication Data

US 2023/0358043 A1 Nov. 9, 2023

Related U.S. Application Data

(60) Provisional application No. 63/078,426, filed on Sep. 15, 2020.

(30) Foreign Application Priority Data

Jun. 4, 2021 (CA) ..... CA 3121067

(51) Int. Cl.
*E04C 2/38* (2006.01)
*E04B 2/00* (2006.01)
*E04C 2/00* (2006.01)

(52) U.S. Cl.
CPC ..... *E04C 2/38* (2013.01); *E04C 2/46* (2013.01); *E04C 2002/004* (2013.01)

(58) Field of Classification Search
CPC ..... E04C 2/38; E04C 2/386; E04B 2/7457; E04B 2002/7461; E04H 9/06
See application file for complete search history.

(56) References Cited

U.S. PATENT DOCUMENTS 1,810,891 A * 6/1931 Bemis ..... E04B 2/56 52/426
4,653,239 A * 3/1987 Randa ..... E04B 1/28 52/283

(Continued)

*Primary Examiner* — Adriana Figueroa
(74) *Attorney, Agent, or Firm* — Teitelbaum & Bouevitch; Neil Teitelbaum

(57) ABSTRACT

A construction system utilizes a post-and-beam structure that supports major gravity loads of a building in combination with prefabricated exterior and/or interior wall panels that are not required to support gravity loads beyond self-weight. Studs within the prefabricated wall panels are oriented such that a widest face thereof is other than normal to the wall surfaces attached thereto. Such an orientation of the wall studs reduces or eliminates thermal bridging in the structure without adding materials, thereby reducing embodied carbon and embodied energy content. The orientation of the wall studs also maximizes the available space within the wall panels to accommodate electrical and plumbing utilities and insulation material and utilizes the studs along their strong axis to resist lateral loads.

16 Claims, 17 Drawing Sheets

(56) References Cited

U.S. PATENT DOCUMENTS

| | | | | |
|---|---|---|---|---|
| 6,655,106 | B1 * | 12/2003 | Sucre | E04B 1/08 52/800.12 |
| 7,150,132 | B2 * | 12/2006 | Commins | E04B 1/26 411/536 |
| 7,926,407 | B1 * | 4/2011 | Hallissy | F42D 5/05 89/36.02 |
| 11,371,242 | B2 * | 6/2022 | May | E04B 1/02 |
| 2005/0188632 | A1 * | 9/2005 | Rosen | H02G 3/388 52/220.2 |
| 2010/0186316 | A1 * | 7/2010 | Buchanan | E04B 1/10 52/223.13 |
| 2013/0167473 | A1 * | 7/2013 | Creel | E04C 2/246 52/800.1 |

* cited by examiner

BUILDING CONSTRUCTION SYSTEM

RELATED APPLICATION DATA

This application is the national stage entry of International Appl. No. PCT/CA2021/051268, filed Sep. 13, 2021, which claims priority to U.S. Patent Application No. 63/078,426 filed Sep. 15, 2020 and Canadian Patent Application No. 3,121,067 filed Jun. 4, 2021.All claims of priority to that application are hereby made, and that application is hereby incorporated in its entirety by reference.

FIELD

The present disclosure relates to a construction system for constructing a building, and in particular to a post-and-beam construction system using prefabricated wall panels having a staggered, multi-row stud arrangement.

BACKGROUND

A wide variety of building techniques are known for constructing residential and commercial buildings. Various factors go into choosing a suitable building technique for a particular project. For instance, some techniques are not suitable due to the constraints that are imposed by local soil conditions, availability of suitable building materials, architectural requirements, and availability of skilled workers. In addition, climatic factors must be taken into consideration, such as for instance the need to provide a given level of insulation in cold climates, the need to withstand strong winds in hurricane or tornado prone areas, and the need to resist collapse in earthquake prone areas.

Traditional stick frame buildings are common in many areas, in which walls and other partitions are built in place on a concrete block or poured concrete foundation system, or on another suitable type of foundation system. Since the interior cavities of the walls and floors etc. are all accessible prior to the inner and outer sheathing materials being attached, it is a relatively simple matter to install insulation, moisture barriers, electrical wiring, plumbing, etc. The wall and floor cavities may then be enclosed using suitable sheathing materials, and optionally additional insulation may be added prior to applying finishing exterior wall surface materials, such as for instance brick/stone or siding. Unfortunately, constructing the frame on-site in this way is time consuming and may be affected by adverse weather conditions, which may additionally result in damage to the building materials due to ingress of rainwater or snow, etc.

Various approaches are also known for constructing buildings using prefabricated panels. One system is based on structural insulated panels (SIPs), which consist of a layer of expanded polystyrene (EPS) or another suitable material sandwiched between two sheets of oriented strand board (OSB) using a structural adhesive. SIPs act as the framing, insulation, and exterior sheathing, they provide a tight building envelope with high insulating properties, and their use can speed construction after the materials are delivered to the construction site. The EPS insulation may be recessed away from the bottom edge of the SIPs, such that the solid EPS insulation sits on top of a preinstalled sill plate and the OSB side boards extend along the side edges of the sill plate. The SIPs are anchored to the sill plate by nailing through the OSB. A disadvantage of SIPs is that the main structural element is the OSB and the adhesion to the insulation, which have been shown to be prone to premature failure due to moisture. In addition, the exterior and interior surfaces of the SIPs must be finished after the frame of the building is completed. This may include attaching drywall or plasterboard along the interior side of the SIPs and attaching additional insulation and brick/stone or siding material along the exterior side of the SIPs. Further, running electrical wiring and plumbing for the building must be done via horizontal and vertical chases that are formed through the solid EPS insulation, and portions of the OSB must be cut out to accommodate electrical boxes etc.

Prefabricated wall panels, which are constructed in a factory using traditional stick frame materials before being delivered to a construction site as panelized units, offer increased convenience and reduce the time that is required to complete a building project. Typically, the interior side of the wall panels remains open until after the building has been erected and all of the insulation, electrical wiring and plumbing has been installed. Since the interior of the wall panels remains accessible during construction, it is a straight-forward matter to nail or bolt the bottom plate of the prefabricated wall panel frames to a floor or foundation system of the building. Unfortunately, the process of running electrical wiring and plumbing may result in studs within the wall panel being drilled through or cut and requires skilled labor to be on-site during the construction of the building. Depending on the skill and care that is taken by the electricians and plumbers, it is possible that the load bearing strength of the wall panels may be compromised. In addition, the exterior and interior surfaces of the wall panels typically must be finished after the frame of the building is completed.

The need thus exists for an improved construction method and system that addresses the above-mentioned drawbacks.

SUMMARY

The present disclosure provides a construction system for constructing a building as well as a prefabricated wall panel for use with the construction system. In some embodiments, the prefabricated wall panel includes a plurality of studs that are arranged in two rows inside the prefabricated wall panel. The rows are offset, such that the studs in one row are not aligned with the studs in the other row across a thickness of the prefabricated wall panel. In some embodiments an interior sheathing material encloses a first side of the prefabricated wall panel and an exterior sheathing material encloses a second side of the prefabricated wall panel that is opposite the first side. In some embodiments, the interior sheathing material is anchored to the studs in the first row and the exterior sheathing material is anchored to the studs in the second row. In some embodiments, the studs are generally rectangular in a cross section that is taken in a plane normal to their length and each of the studs is oriented such that a widest face thereof, as viewed in the cross section, is arranged parallel to and in contact with a respective one of the interior sheathing material and the exterior sheathing material. In some embodiments, the studs have a generally irregular pentagonal prism shape in a cross section that is taken in a plane normal to their length and the studs are oriented such that an angled face thereof is parallel to and in contact with a respective one of the interior sheathing material and the exterior sheathing material. In some embodiments, floor and/or roof panels having a configuration that is similar to the prefabricated wall panels are also used in the construction system.

The construction system that is disclosed herein utilizes a post-and-beam structure that supports major gravity loads of the building so that the exterior walls and/or interior walls are not required to support the gravity loads beyond self-weight. This results in the option to orient the wall studs to reduce and eliminate thermal bridging in the structure without adding materials, thereby reducing embodied carbon and embodied energy content. The orientation of the wall studs also maximizes the available space within the wall to accommodate electrical and plumbing utilities and insulation material and utilizes the studs along their strong axis to resist lateral loads.

Building a structure having walls constructed in this manner also allows for a smaller number of structural connections to connect the structure together, which results in more efficient design for the various gravity and lateral loads.

In a preferred embodiment the walls panels may have complementary fittings which fit into channels of various geometries securing them to the floor upon which they are installed, this limits the amount of movement in one or more directions, with the exception of the positive-z-direction, i.e., the upward direction or uplift direction. Structural adhesives and other methods of connection may also be used that provide some resistance to movement in the positive z-direction.

The floors of the building may be designed utilizing appropriately configured prefabricated floor panels, where the rim board is not utilized to support the compression loads, but also doubles as a flexural member (horizontal edge beam) spanning between the columns. The horizontal edge beams transmit gravity loads of the building to the foundation via the columns.

A foundation system may be constructed using stay in-place forms that capitalize on the loads being transmitted through a number of posts. This allows the concrete wall sections other than those supporting columns directly to be thinner or less reinforced, or to be of a different material, leading to a more economical, lower embodied carbon, lower embodied energy design. The portions of the concrete foundation system supporting the columns are designed to a higher level of utilization.

Finally, the connection between the building and the foundation upon which it is built, i.e., to prevent movement of the building including uplift along the positive-z-direction, is achieved by connecting the columns and beams from the top of the building structure to the foundation wall using rod or cable anchors with added tension to apply a downward pulling force. Optionally, this connection to the foundation wall may be released to allow the building to be disassembled by reversing the steps that were performed during construction. Thus, it becomes possible to move a building from one location to another. The use of rod or cable anchors overcomes the limitation that is imposed by using prefabricated wall panels that are fully finished on both the exterior and interior sides. That is to say, the bottom plate of the fully finished prefabricated wall panels is not accessible, and therefore it is not possible to secure the wall panels to the floor or foundation system in the typical way, which normally involves bolting or screwing through the bottom plate and into the floor or foundation surface below the wall. The prefabricated wall panels are therefore assembled into the building absent connectors (bolts/screws) passing through the bottom plate thereof and into a floor or foundation system below the prefabricated wall panels—the rod or cable anchors secure the prefabricated wall panels in place. Of course, as will be apparent, additional connectors and guides may be provided to limit the movement of the walls in the lateral and/or vertical directions (i.e., the x-direction, y-direction and/or z-direction).

In accordance with an aspect of at least one embodiment there is provided a construction system for constructing a building, comprising: a horizontal beam for supporting a vertical load of the building; a plurality of columns for supporting the horizontal beam and for transmitting the vertical load to a foundation of the building; a plurality of rod or cable anchors, each of the anchors having a first end for being coupled to the foundation, or to a footer below the foundation, and having a second end for being coupled to an upper end of one of the columns or to the horizontal beam; a plurality of locking and tensioning mechanisms, each locking and tensioning mechanism for adding tension to a respective one of the plurality of rod or cable anchors when said anchors are in a coupled condition between the foundation or the footer and the upper end of the one of the columns or the horizontal beam, and for maintaining the respective one of the plurality of rod or cable anchors under said tension; and a prefabricated wall panel having a covered interior-facing side and a covered exterior-facing side, wherein the prefabricated wall panel, the horizontal beam, and the plurality of columns cooperate to form at least a portion of an exterior wall of the building, and wherein, in an assembled condition, the plurality of rod or cable anchors cooperate with the plurality of locking and tensioning mechanisms to exert a pulling force along a downward direction toward the foundation for opposing an upward lifting force exerted on the at least a portion of the exterior wall of the building.

In accordance with an aspect of at least one embodiment there is provided a prefabricated wall panel for use in a construction system for constructing a building, comprising: a horizontal top plate and a horizontal bottom plate; one or more front panels extending between the top and bottom plates and forming a first wall surface adjacent to a first side of the frame; one or more back panels extending between the top and bottom plates and forming a second wall surface adjacent to a second side of the frame that is opposite the first side; and a plurality of studs extending along a length direction thereof between the top plate and the bottom plate, wherein the studs are disposed between the one or more front panels and the one or more back panels and are arranged in first and second rows that are offset one relative to the other along a width direction of the wall panel, wherein the studs in the first row are in contact with the one or more front panels but not with the one or more back panels and the studs in the second row are in contact with the one or more back panels but not with the one or more front panels, and wherein each stud is oriented such that a widest face thereof, in a cross-section taken in a plane that is normal to the length direction of the stud, is other than normal to a respective one of the one or more front panels or the one or more back panels.

BRIEF DESCRIPTION OF THE DRAWINGS

The instant disclosure will now be described by way of example only, and with reference to the attached drawings, in which.

DETAILED DESCRIPTION

While the present teachings are described in conjunction with various embodiments and examples, it is not intended that the present teachings be limited to such embodiments. On the contrary, the present teachings encompass various alternatives and equivalents, as will be appreciated by those of skill in the art. All statements herein reciting principles, aspects, and embodiments of this disclosure, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

As used herein, the terms "first", "second", and so forth are not intended to imply sequential ordering, but rather are intended to distinguish one element from another, unless explicitly stated. Similarly, sequential ordering of method steps does not imply a sequential order of their execution, unless explicitly stated.

As used herein, the terms "horizontal" and "vertical" refer to an orientation of an element when that element is installed in a finished building. An element that is described as being vertical may be oriented generally along the direction of gravitational acceleration, or may be oriented 5°, 10°, 15°, 20° from the direction of gravitational acceleration. An element that is described as being horizontal may be oriented generally perpendicular to the direction of gravitational acceleration, or may be oriented 5°, 10°, 15°, 20° from perpendicular to the direction of gravitational acceleration.

As used herein, the terms "top" and "bottom" refer to different elements or to portions of a same element when installed in a finished building. For instance, a "top" plate is disposed vertically above a "bottom" plate in the finished building.

As used herein, the terms "upper" and "lower" refer to different elements or to portions of a same element when installed in a finished building. For instance, an "upper" end of a column is disposed vertically above a "lower" end of the column in the finished building.

As used herein, the term "interior-facing surface" refers to the surface of a prefabricated wall panel that faces toward the interior of a building and the term "exterior facing surface" refers to the surface of a prefabricated wall panel that faces toward the exterior of a building, when the prefabricated wall panel forms at least part of an exterior wall of the finished building.

Figure 1A:
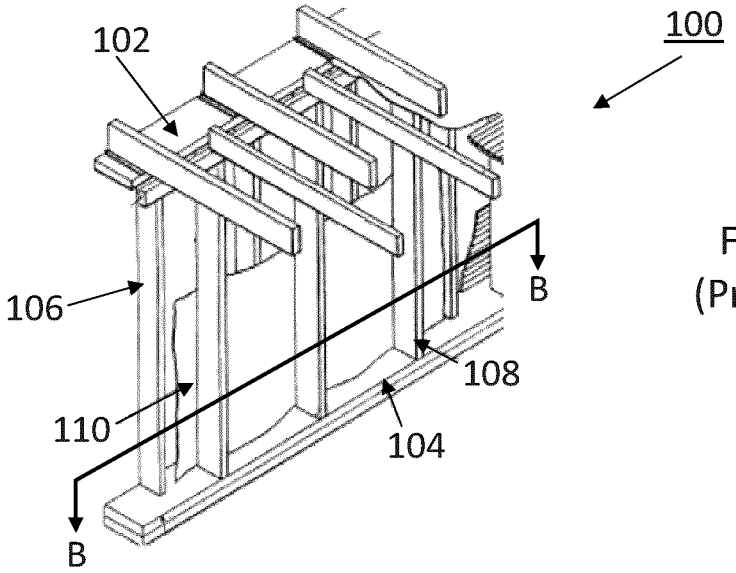
FIG. 1A (Prior Art)
FIG. 1A is a simplified diagram showing a perspective view of a prior art stick-built wall with staggered rows of studs.

Referring now to FIG. 1A, shown is a simplified perspective view of a prior art stick-built wall with two staggered rows of studs. As is typical of stick-built frames, the wall 100 includes a top plate member 102 and a bottom plate member 104. The wall 100 further includes two rows of studs, including a plurality of studs 106 proximate an exterior side of the wall and a plurality of studs 108 proximate an interior side of the wall. Now referring also to FIG. 1B, the studs 106 are offset from the studs 108 along a width direction of the wall. As such, the studs 106 and 108 do not face directly toward one another, and none of the studs 106 or 108 extend the full thickness of the wall 100 between the exterior side and the interior side. This construction offers at least two advantages over more traditional stick-built framing. Firstly, the studs 106 and 108 do not form a thermal bridge between the exterior surface 112 and the interior surface 114 of the wall 100, and secondly the relative arrangement of the studs 106 and 108 makes it possible to dispose a continuous sheet of insulation material 110 within the wall cavity and extending along the width direction of the wall 100.

Figure 1B:
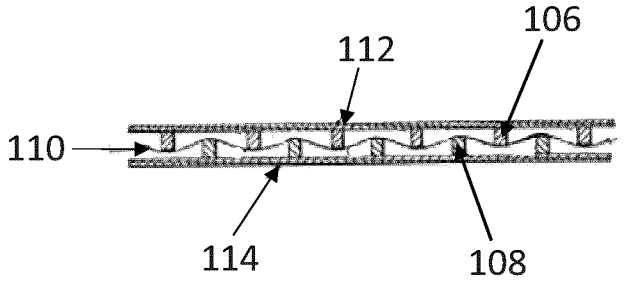
FIG. 1B (Prior Art)
FIG. 1B is a cross-sectional view taken along the line B-B in FIG. 1A.

As will be apparent, the studs 106 and 108 have a rectangular shape and may be e.g., nominal 2×4 boards or nominal 2×6 boards. The studs 106 and 108 are arranged with one of their narrow faces parallel to and in contact with the exterior surface 112 or the interior surface 114, respectively, of the wall 100. As a result, the studs 106 and 108 are partially interleaved and the insulation material 110 follows a somewhat torturous path along the width direction of the wall 100. Since the studs 106 and 108 are partially interleaved, the insulation material 110 becomes partially compressed, which reduces the insulative properties of the insulation material. Despite this drawback, the studs 106 and 108 must be arranged in the way that is shown in FIGS. 1A and 1B to meet the minimum building code requirements for load-bearing walls, i.e., to ensure that the wall 100 is able to support the weight of the structure of the completed building of which it is a part.

The instant disclosure provides a solution that yields higher insulative properties, and therefore lower energy consumption, compared to currently known building techniques. The solution combines the use of non-load bearing, prefabricated wall panels in a post-and-beam frame. Since the post-and-beam frame provides the load-bearing structure of the building, the prefabricated wall panels are not required to meet the same building code requirements that apply to traditional load-bearing frame walls. The prefabricated wall panels that are disclosed herein are constructed in such a way as to maximize a distance between two rows of studs, with the two rows of studs being offset one relative to the other along a width direction of the wall panel such that the studs in the two rows do not directly face one another.

The additional space compared to prior art walls makes it possible to accommodate more insulation material within the prefabricated wall panel without compressing the insulation material by more than about 25% relative to the uncompressed insulation material thickness. In some embodiments the insulation material in the prefabricated wall panel is essentially uncompressed. Advantageously, relatively uncompressed insulation material results in more loft, less heat loss and higher effective insulation value. For example, using a nominal 2×6 frame with nominal 2×4 studs oriented so that a maximum space is provided between each stud and an opposite wall, to which the stud is not attached, reduces or eliminates thermal bridging effects and yields an energy savings of approximately 10% over the prior art construction shown in FIGS. 1A and 1B. The energy savings for a steel stud wall system may be as high as 20%. Further advantageously, in jurisdictions that regulate characteristics such as thermal bridging, effective R-value, or continuous insulation in buildings, the disclosed construction system may result in substantial savings since less insulation material may be used to meet the regulated minimum requirements.

Figure 2A:
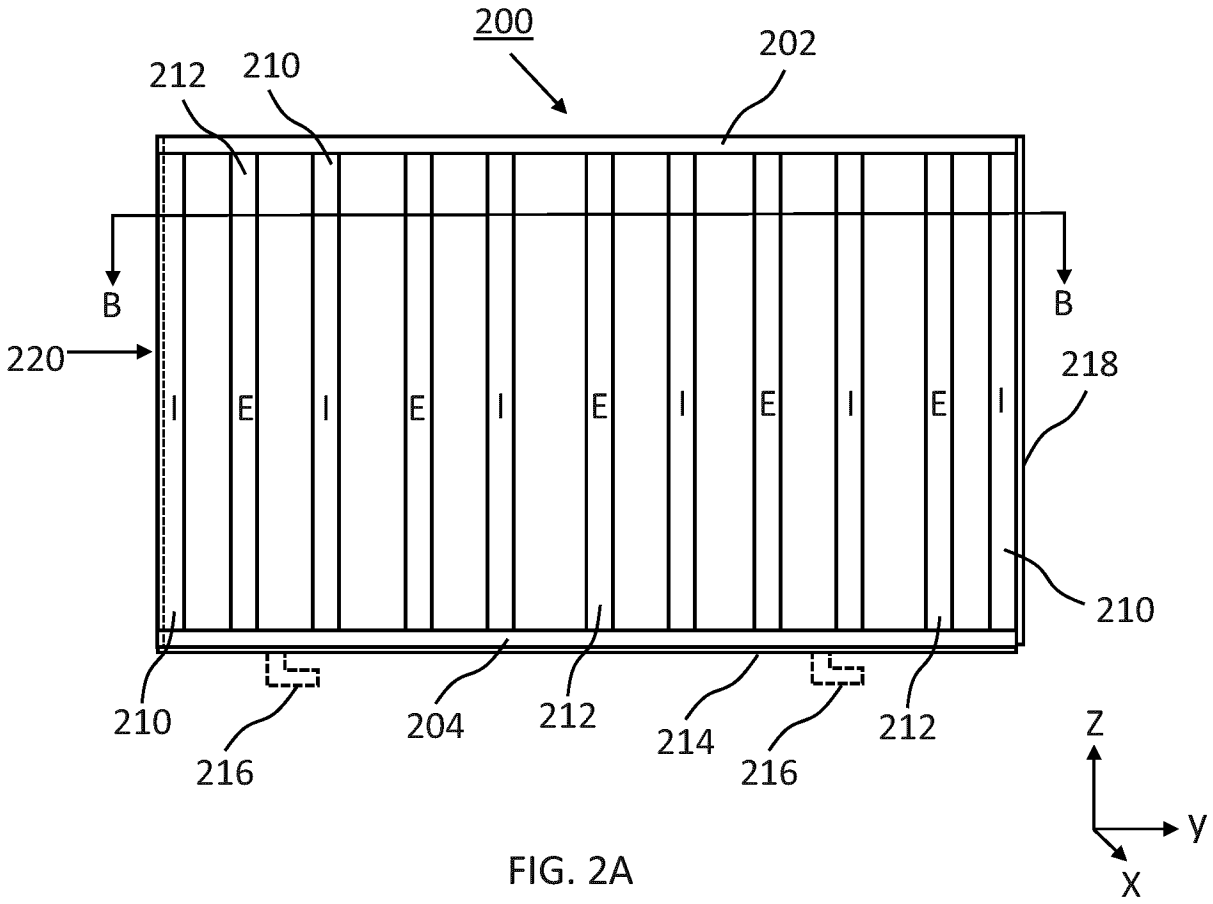
FIG. 2A is a simplified front view showing the internal studs of a prefabricated wall panel according to an embodiment.

FIG. 2A is a front view of a wall panel 200 according to an embodiment, which is shown without interior or exterior wall surfaces attached and without insulation material etc. disposed therein. The wall panel 200 includes a horizontal top plate 202 and a horizontal bottom plate 204. The top plate 202 and/or the bottom plate 204 each may be a single plate, or a double plate or a triple plate, etc., and may be fabricated from wood, manufactured wood product, construction grade steel, or another suitable material. The top plate 202 and the bottom plate 204 may be e.g., of a standard size such as for instance a nominal 2×6.

The prefabricated wall panel 200 further includes a plurality of studs, disposed within an interior cavity thereof, including first studs 210 (labeled "I" in FIG. 2A) arranged in a first row that is proximate a side of the wall panel 200 that faces an interior of the building, and second studs 212 (labeled "E" in FIG. 2A) arranged in a second row proximate a side of the wall panel 200 that faces an exterior of the building. The studs 210 and 212 extend along a length thereof between the top plate 202 and the bottom plate 204. A first end of each of the studs 210 and 212 is fastened to the top plate 202 and a second end of each of the studs 210 and 212 is fastened to the bottom plate 204. Suitable mechanical fasteners, such as for instance nails, screws, gang plates, etc., may be used to attach the studs 210 and 212 to the top and bottom plates 202 and 204. Although not shown in FIG. 2A, the prefabricated wall panel may include framing for openings such as doors and windows.

The prefabricated wall panel 200 further includes various features for aligning and securing the prefabricated wall panels to a floor section and/or to adjacent prefabricated wall panels and/or columns of the post-and-beam structure. In some embodiments, bottom plate 204 of the prefabricated wall panel 200 comprises a first portion of a coupling for securing the prefabricated wall panel 200 to a mating second portion of the coupling formed along the floor section (not shown in FIG. 2A), wherein the coupling limits at least lateral movement of the prefabricated wall panel 200 relative to the floor section (i.e., in the x-direction and/or in the y-direction). For instance, the prefabricated wall panel 200 may include a tongue-like or pin-like element 214 along the bottom plate 204, which may be received in a mating groove, track or hole (not illustrated) formed in the floor section. The tongue-like or pin-like element 214 and the groove, track or hole restrict or eliminate lateral movement of the prefabricated wall panel 200, i.e., prevents the bottom of the prefabricated wall panel from sliding inwardly or outwardly when installed as part of a wall of the building. Optionally, adhesive pads or tape, glue, etc. may be disposed between the first and second portions of the coupling to help secure the prefabricated wall panel in place on the floor section.

The prefabricated wall panel 200 may additionally include a tongue-like or pin-like element 218 formed along one end thereof, and a groove, track or hole 220 formed along the opposite end thereof. When in an assembled condition, the tongue-like or pin-like element 218 of one prefabricated wall panel 200 is received within the groove, track or hole 220 of an adjacent prefabricated wall panel 200. The tongue-like or pin-like element 218 and groove, track or hole 220 restrict or eliminate lateral movement of the prefabricated wall panel 200 in the finished building, and also facilitate assembly by guiding the wall panels 200 into their desired locations.

The prefabricated wall panel 200 may additionally or alternatively include one or more retention tabs 216 extending from the bottom plate 204, which are received in mating retention slots (not illustrated in FIG. 2A) that are formed in a floor section beneath the panel 200. During construction of the building, the prefabricated wall panel 200 is placed on the floor section with the retention tabs 216 inserted into an insertion section of the retention slots. The prefabricated wall panel 200 is then slid into a secured condition, in which a distal end of the retention tabs 216 is within a retention portion of the retention slots. In the secured condition, the prefabricated wall panel is substantially prevented from moving in the positive-z-direction. Advantageously, the retention tabs 216 and not illustrated retention slots also facilitate assembly by guiding the wall panels 200 into their desired locations.

Figure 2B:
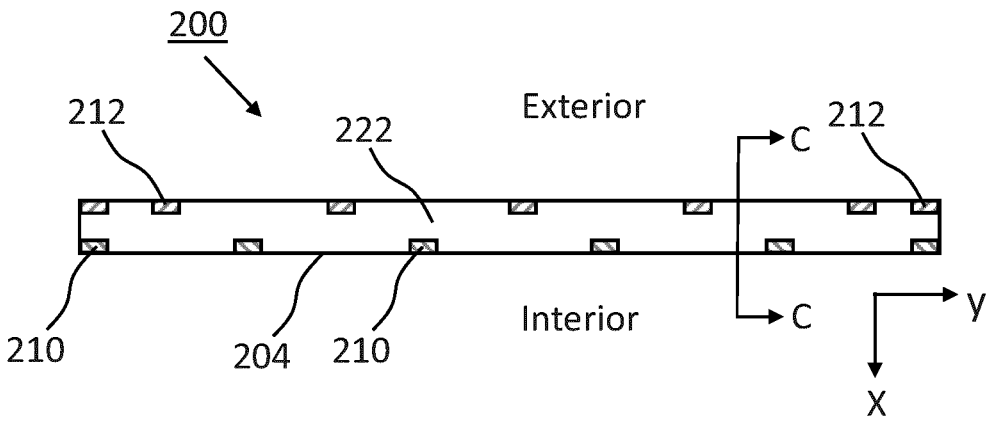
FIG. 2B is a cross-sectional view taken along the line B-B in FIG. 2A.
Figure 5A:
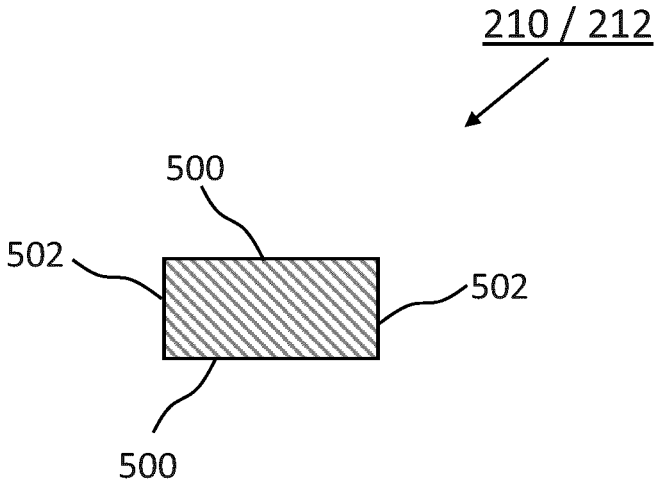
FIG. 5A is a cross-sectional view of a stud having a rectangular shape in a plane that is normal to a length direction thereof.

Referring now to FIG. 2B and also to FIG. 5A, each one of the first studs 210 and each one of the second studs 212 is attached between the top plate 202 and the bottom plate 204 in an orientation in which a widest face 500 of the stud 210 or 212, viewed in a cross-section that is taken in a plane normal to the length of the stud, is parallel to the length direction of the top plate 202 and bottom plate 204. Stated differently, as is shown most clearly in FIG. 2C, the widest face 500 of each stud 210 is substantially flush with a plane IN along the interior side of the prefabricated wall panel 200 and the widest face 500 of each stud 212 is substantially flush with a plane EX along the exterior side of the prefabricated wall panel 200. By rotating the studs 210 and 212 approximately 90° about the length axes thereof, relative to the stud orientation that is shown in prior art FIGS. 1A and 1B, each stud 210 and 212 extends toward the opposite side of the prefabricated wall panel 200 by a minimum amount, which is equal to the dimension of the relatively narrower face 502 of the studs.

Figure 2C:
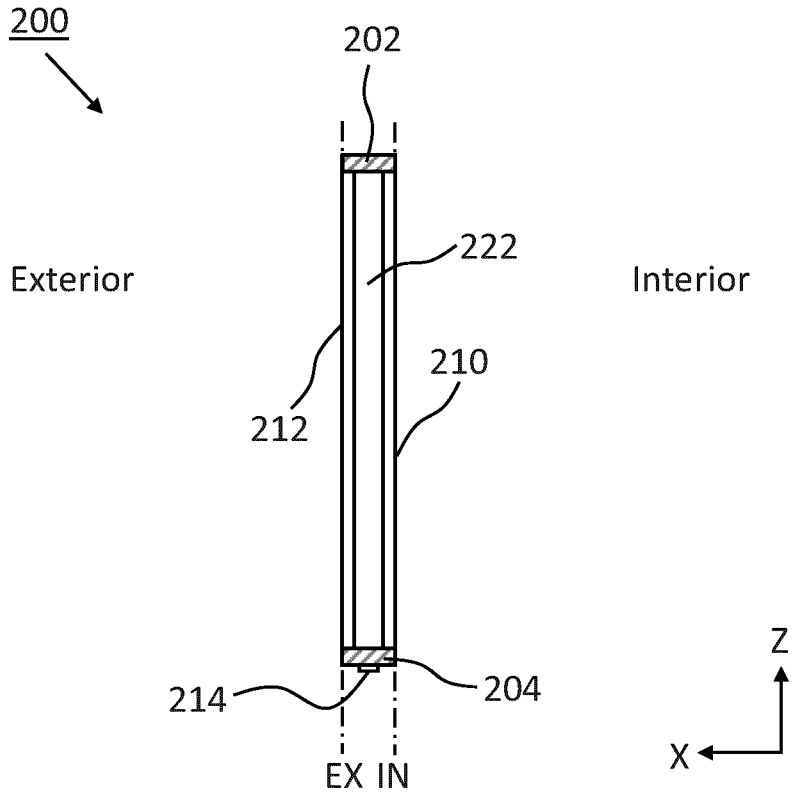
FIG. 2C is a cross-sectional view taken along the line C-C in FIG. 2B.

Advantageously, the studs 210 and 212 do not become partially interleaved with one another when they are oriented as shown in FIGS. 2A-2C. This allows for insulation of various types to be installed in the space 222 between the studs 210 and 212, without reducing the thermal resistance at the location of the studs, and while maintaining continuous insulation between the top and bottom plates and eliminating or significantly reducing thermal bridging. An improvement of 7% to 20% in thermal resistance may be achieved compared to a prior art wall using the same amount of insulation. In addition, plumbing and/or electrical wires or conduits may be passed through the space 222 between the studs 210 and 212, as required.

Figure 3A:
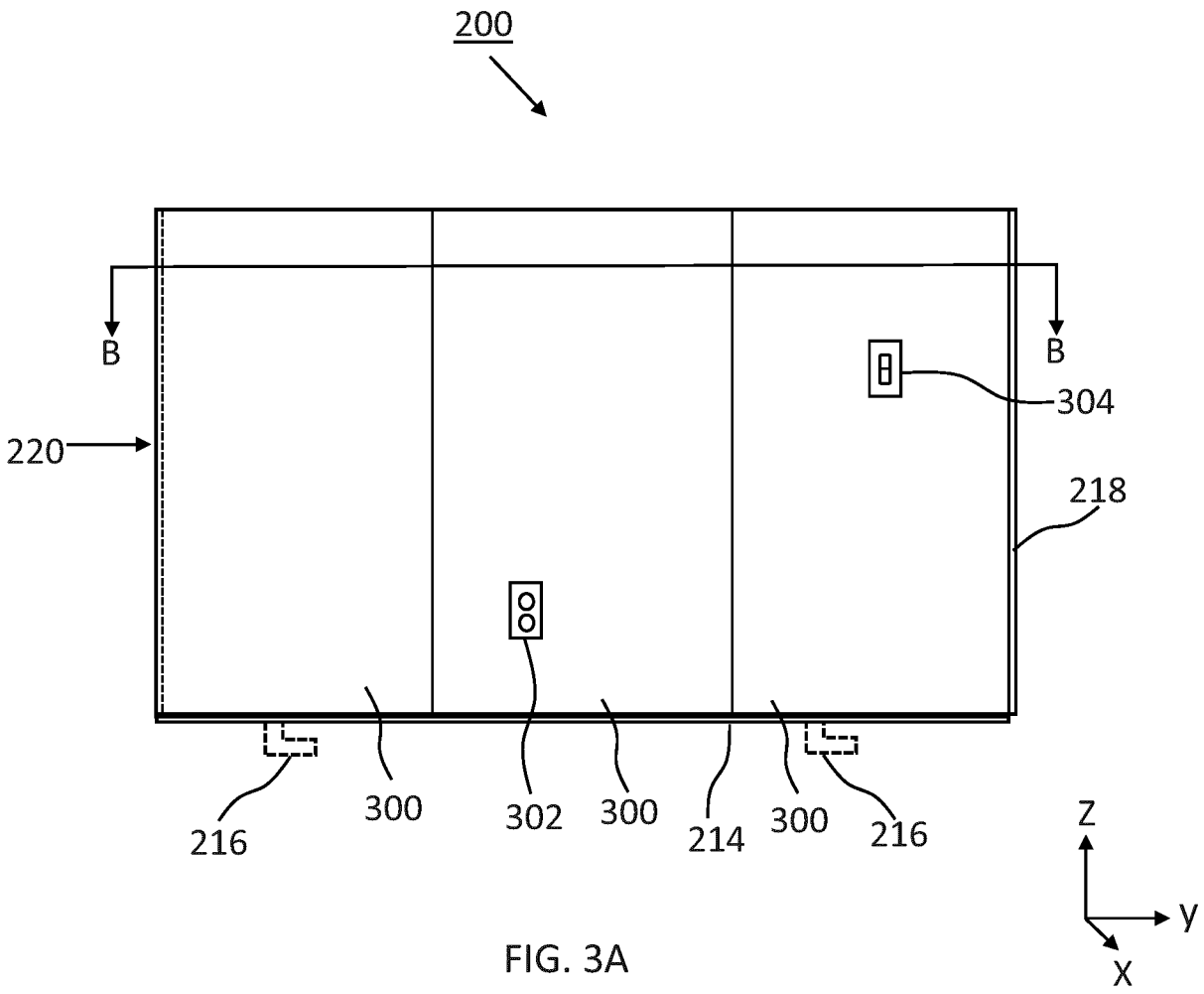
FIG. 3A is a simplified front view of a finished wall panel according to an embodiment.

Referring now to FIG. 3A, shown is a simplified front view of a finished wall panel 200 according to an embodiment. FIG. 3A shows the same wall panel frame and stud system that was discussed with reference to FIGS. 2A-2C, but with one or more front panels disposed along the interior side thereof. In particular, the prefabricated wall panel 200 is shown in FIG. 3A with three front panels 300 attached thereto, such as for instance three sheets of drywall or another suitable interior sheathing, which provides an interior wall surface. The front panels 300 may be secured to the frame of the prefabricated wall panel 200 such as for instance by placing drywall screws or other suitable fasteners through the front panels 300 and into the studs 210, which are disposed adjacent to and in contact with the front panels 300.

Figure 3B:
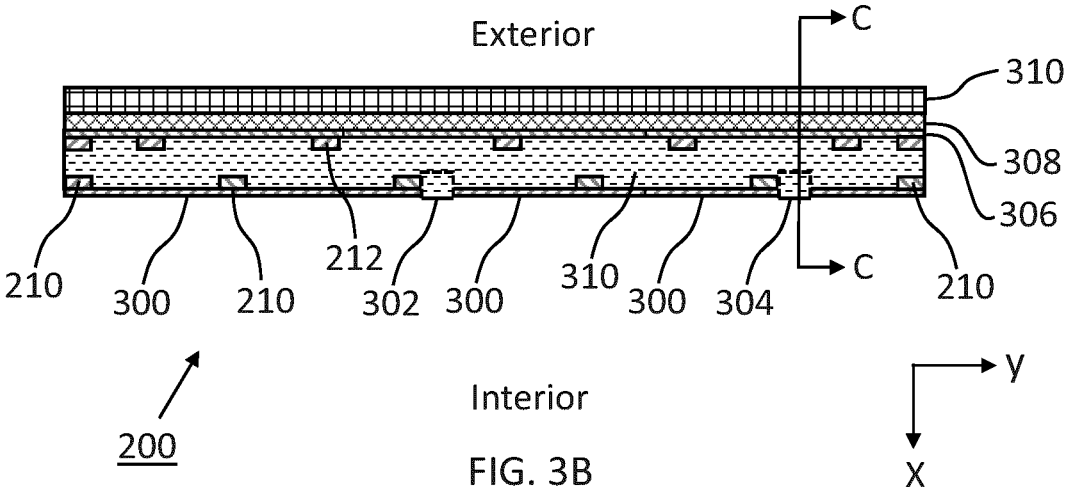
FIG. 3B is a cross-sectional view taken along the line B-B in FIG. 3A.
Figure 3C:
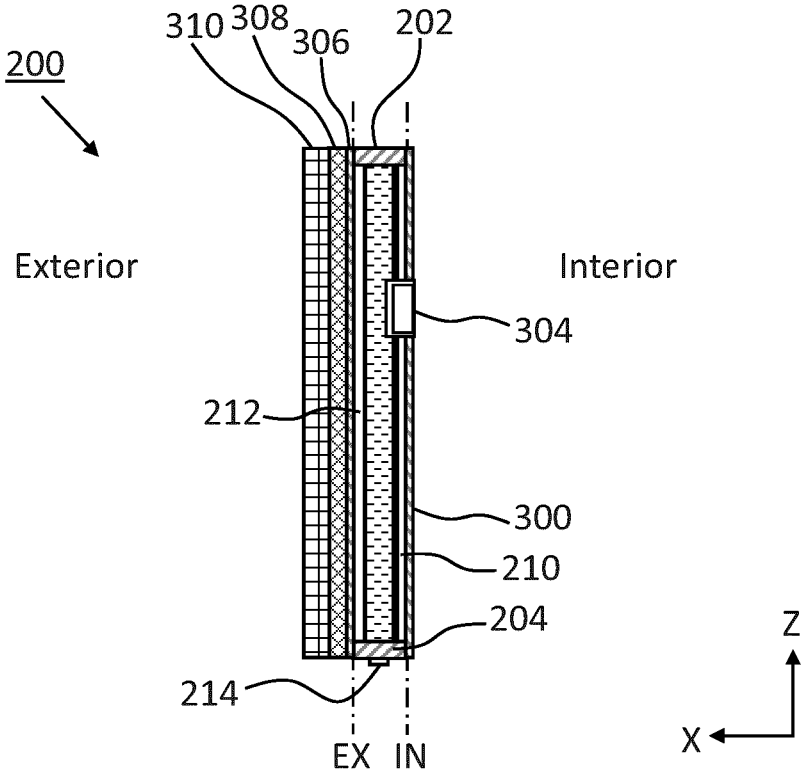
FIG. 3C is a cross-sectional view taken along the line C-C in FIG. 3B.

Now referring also to FIGS. 3B and 3C, the prefabricated wall panel 200 is preferably fully finished prior to being delivered to a construction site and being incorporated into a building. In particular, electrical wiring (not shown), electrical boxes with outlets 302 and/or switches 304, and optionally plumbing, are preinstalled in the prefabricated wall panel 200 and are ready to be connected into an electrical system or a plumbing system of the building. For instance, the electrical wiring may be routed to a custom junction box in one location, where all wires may be labeled, which facilitates performing maintenance, adding new wires and circuits, submetering, troubleshooting, etc. A similar approach may be used with the preinstalled plumbing, which may be routed to a water meter and may connect to a custom manifold.

The finished prefabricated wall panel 200 preferably also includes an exterior sheathing 306 attached to the exterior side thereof, as well as optional exterior insulation 308 and an exterior finish 310, such as for instance one or more of aluminum/plastic/wood siding, brick/stone, etc.

Further, the interior-facing surface of the one or more front panels 300 may have paint or wallpaper applied thereto. As such, the prefabricated wall panel 200 may require no further decoration or finishing after being incorporated into the building.

Figure 4A:
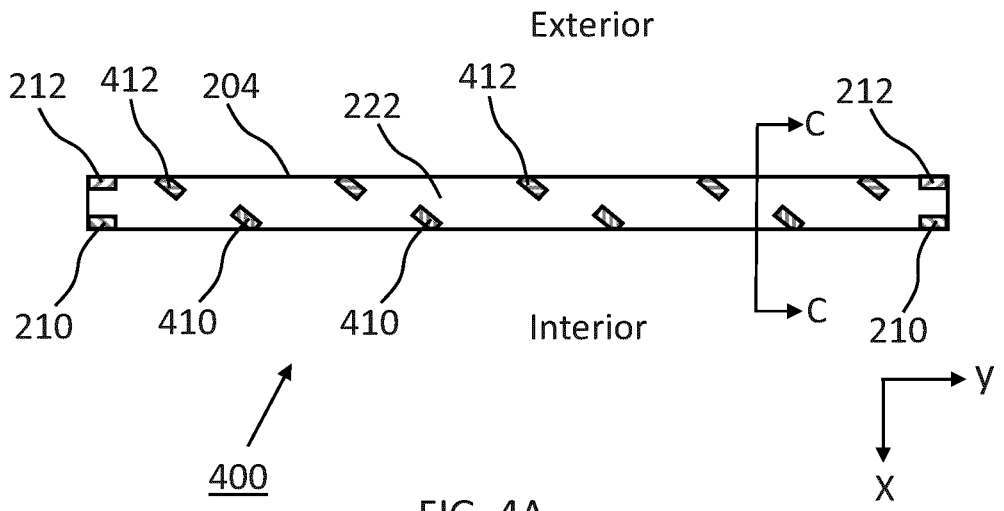
FIG. 4A is a cross-sectional view showing an alternative stud configuration.
Figure 4B:
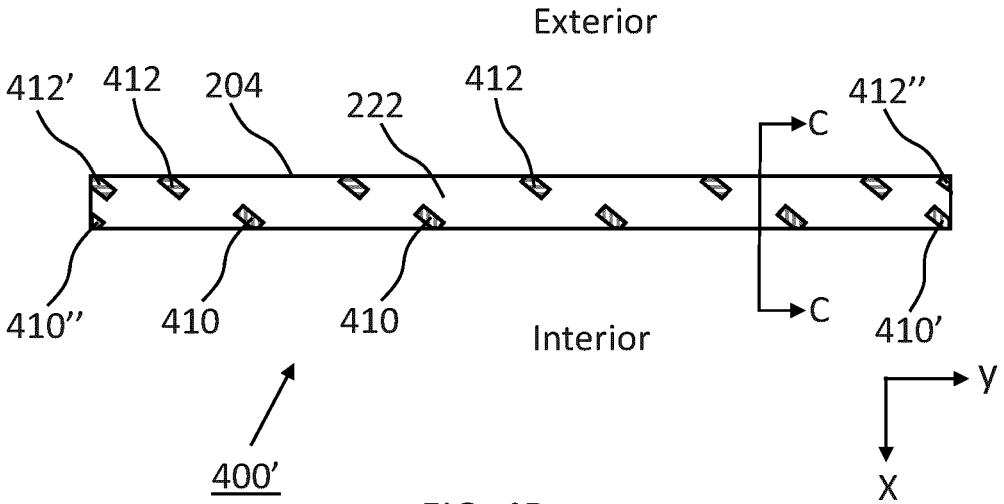
FIG. 4B is a cross-sectional view showing another stud configuration.
Figure 4C:
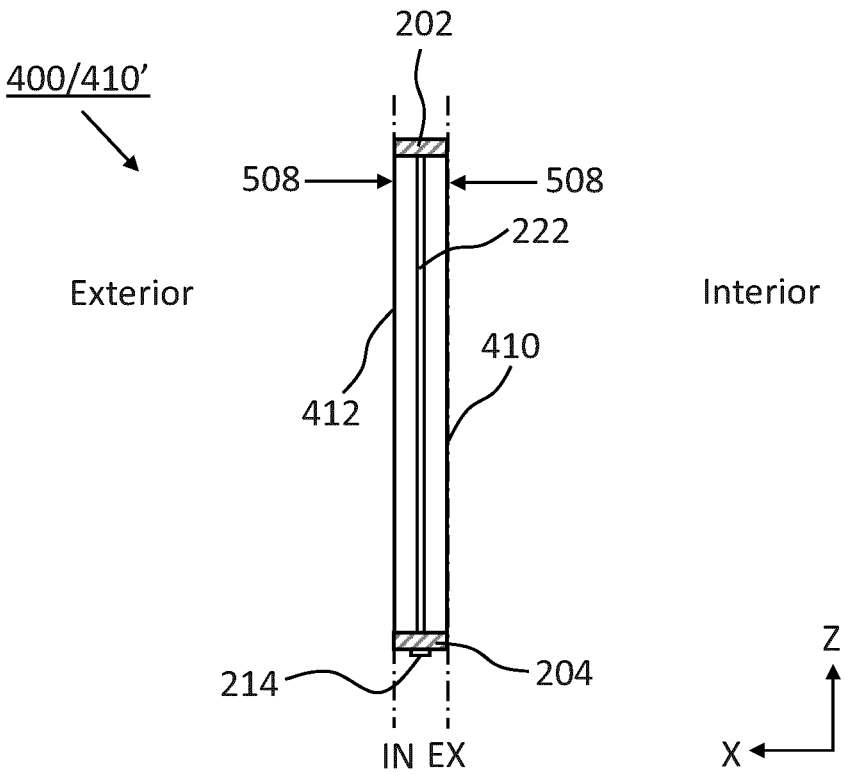
FIG. 4C is a cross-sectional view of the alternative stud configurations taken along the line C-C in either FIG. 4A or FIG. 4B.

Alternative stud configurations may be envisaged without departing from the scope of the invention. Some specific and non-limiting examples of alternative stud configurations are shown in FIGS. 4A and 4B, which are cross-sectional views similar to the view that is shown in FIG. 2B. FIG. 4C is a cross-sectional view that is similar to the view shown in FIG. 2C, but which is taken along the line C-C in either one of FIGS. 4A and 4B.

Figure 5B:
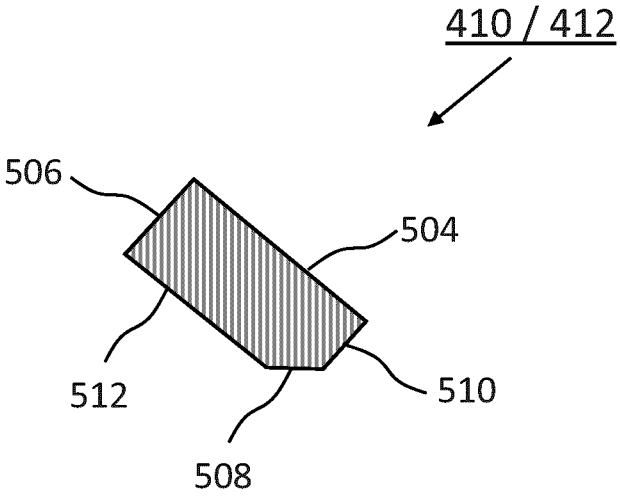
FIG. 5B is a cross-sectional view of a stud having an irregular pentagonal prism shape in a plane that is normal to a length direction thereof.

Referring now to FIG. 4A, most of the studs 210 and 212 described above with reference to FIGS. 2A-2C are replaced with studs 410 and 412, respectively, which have the shape of an irregular pentagonal prism when viewed in a cross-section that is taken in a plane normal to their length. The studs 410 and 412 are rotated about their length axes within the prefabricated wall panel 400, such that an angled face 508 thereof is parallel to the length direction of each of the top plate 202 and bottom plate 204. Stated differently, as shown most clearly in FIG. 4C and with reference also to FIG. 5B, the angled face 508 of each stud 410 is substantially flush with the plane IN along the interior side of the prefabricated wall panel 400 and the angled face 508 of each stud 412 is substantially flush with the plane EX along the exterior side of the prefabricated wall panel 400. The studs 410 and 412 may be formed, for instance, by making a bevel cut along the length of a rectangular stud, such as for instance a nominal 2×4 stud. The angled face 508 is formed between adjacent faces 508 and 510, as shown in FIG. 5B. Nominal 2×4 studs or other suitable supports, for example studs 210 and 212, may be provided proximate both ends of the prefabricated wall panel 400 as shown in FIG. 4A. The studs 210 and 212 provide surfaces for securing not illustrated interior and exterior sheathing material, respectively, of the finished wall panel 400. The prefabricated wall panel 400 has open ends, which prevents thermal bridging between the interior and exterior surfaces thereof. Advantageously, the alternative stud configuration shown in FIG. 4A provides increased stiffness along the x-direction and along the y-direction.

Referring now to FIG. 4B, shown is another alternative stud configuration similar to the one that is shown in FIG. 4A. Once again, most of the studs 210 and 212 described above with reference to FIGS. 2A-2C are replaced with studs 410 and 412, respectively, which have the shape of an irregular pentagonal prism when viewed in a cross-section that is taken in a plane normal to their length. The studs 410 and 412 are rotated about their length axes within the prefabricated wall panel 400', such that an angled face 508 thereof is parallel to the length direction of each of the top plate 202 and bottom plate 204. Stated differently, as shown most clearly in FIG. 4C and with reference also to FIG. 5B, the angled face 508 of each stud 410 is substantially flush with the plane IN along the interior side of the prefabricated wall panel 400' and the angled face 508 of each stud 412 is substantially flush with the plane EX along the exterior side of the prefabricated wall panel 400'. The studs 410 and 412 may be formed, for instance, by making a bevel cut along the length of a rectangular stud, such as for instance a nominal 2×4 stud. The angled face 508 is formed between adjacent faces 508 and 510, as shown in FIG. 5B. Studs 410', 410", 412' and 412", which may be formed by making an appropriate second bevel cut along the length of a rectangular stud, may be provided adjacent the ends of the prefabricated wall panel 400' as shown in FIG. 4B. The studs 410', 410", 412' and 412" provide surfaces for securing not illustrated interior and exterior sheathing of the finished wall panel 400'. As shown in FIG. 4B, the prefabricated wall panel 400' also has open ends, which prevents thermal bridging between the interior and exterior surfaces thereof. Advantageously, the alternative stud configuration shown in FIG. 4B provides increased stiffness along the x-direction and along the y-direction.

Figure 6A:
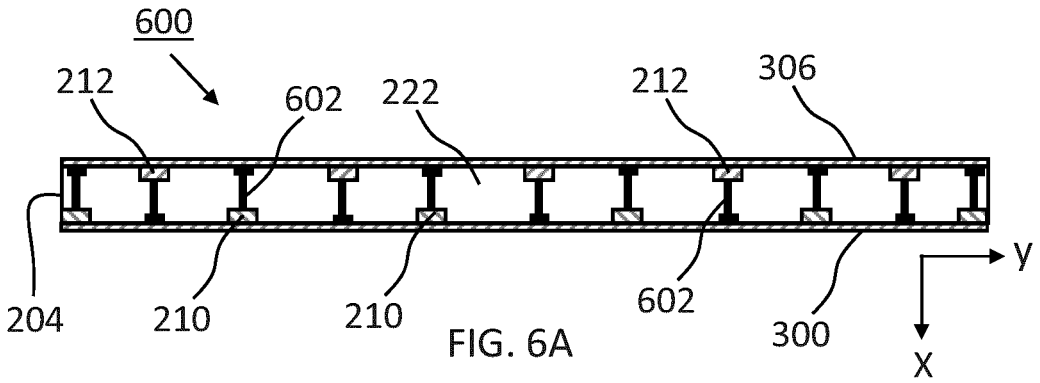
FIG. 6A is a simplified diagram showing an alternative arrangement of studs, including a plurality of support brackets.
Figure 6B:
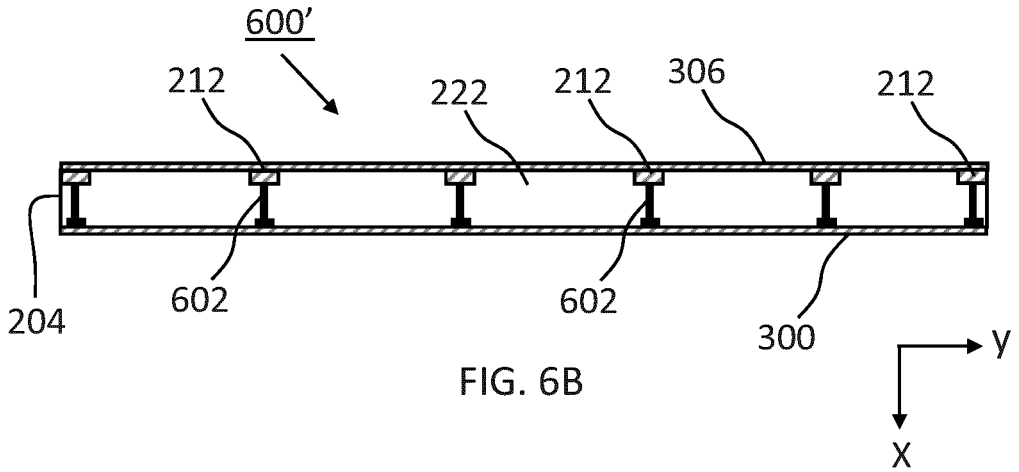
FIG. 6B is a simplified diagram showing another alternative arrangement of studs, including a plurality of support brackets.
Figure 6C:
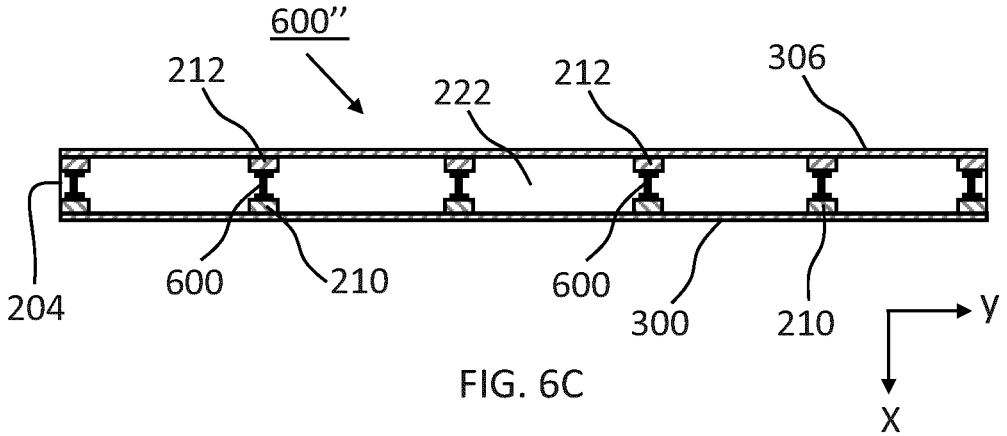
FIG. 6C is a simplified diagram showing yet another alternative arrangement of studs, including a plurality of support brackets.

Referring now to FIGS. 6A-6C, shown are alternative stud configurations that include a plurality of brackets for at least partially supporting the interior sheathing 300 disposed along the interior-facing side of the prefabricated wall panel and/or the exterior sheathing 306 disposed along the exterior-facing side of the prefabricated wall panel. FIG. 6A shows a prefabricated wall panel 600 having a stud configuration similar to that shown in FIG. 2B, but with brackets 602 extending from studs 210 toward the exterior sheathing 306 and with brackets 602 extending from the studs 212 toward the interior sheathing 300. FIG. 6B shows a prefabricated wall panel 600' having an alternative stud configuration in which studs 212 are disposed adjacent to the exterior sheathing 306 but the studs 210 are omitted entirely, and with brackets 602 extending from the studs 212 toward the interior sheathing 300. FIG. 6C shows a prefabricated wall panel 600" having a stud configuration in which the studs 210 and 212 are disposed in rows that are aligned with one another, such that the studs 210 directly face the studs 212, and with brackets 602 extending from the studs 210 toward the studs 212.

In each case, the brackets 602 may be fabricated from plastic, wood, metal or another suitable material. The brackets 602 preferably do not extend the entire distance between the top plate 202 and the bottom plate 204. For instance, each bracket 602 has a height of between about 6 inches and about 15 inches. More than one bracket 602 may be disposed in a spaced-apart stacked arrangement, i.e., brackets 602 may be fastened at different heights within the prefabricated wall panels, and the heights (along the Z-direction) may be staggered along the width (Y-direction) of the prefabricated wall panel 200. The specific configuration of the studs and brackets in the wall panels shown in FIGS. 6A-6C may be designed to meet specific requirements for a particular construction project.

Figure 7A:
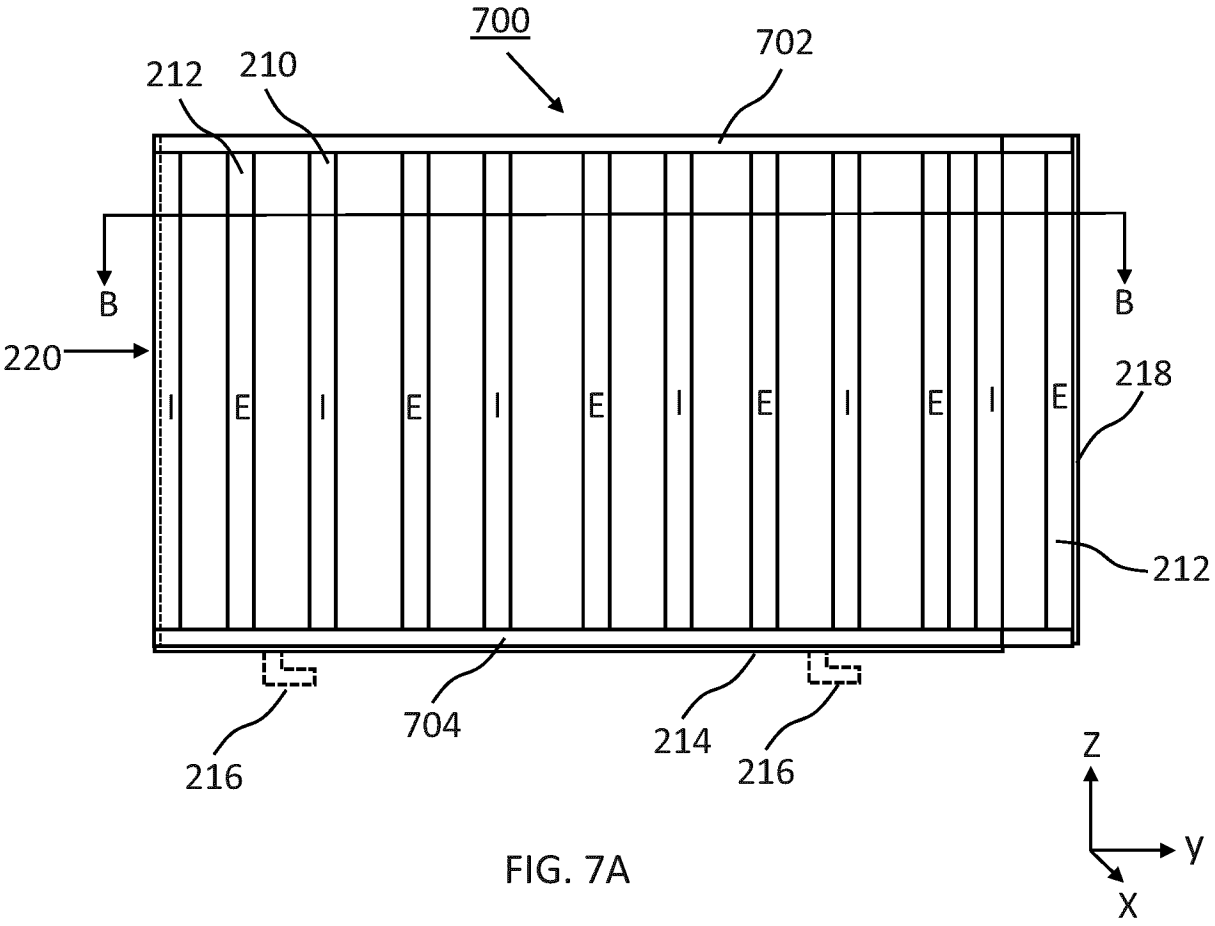
FIG. 7A is a simplified front view showing the internal studs of a prefabricated wall panel according to another embodiment.

FIG. 7A is a front view of a wall panel 700 according to an embodiment, which is shown without interior or exterior wall surfaces attached and without insulation material etc. disposed therein. The wall panel 700 has a horizontal top plate 702 and a horizontal bottom plate 704. The top plate 702 and/or the bottom plate 704 each may be a single plate, or a double plate or a triple plate, etc., and may be fabricated from wood, manufactured wood product, construction grade steel, or another suitable material. The top plate 702 and the bottom plate 704 may be e.g., of a standard size such as for instance two-by-six inches. However, the ends of each of the top plate 702 and 704 are notched, as described in more detail below.

The prefabricated wall panel 700 further includes a plurality of studs, disposed within an interior cavity thereof, including first studs 210 arranged in a first row that is proximate a side of the wall panel 700 that faces an interior of the building, and second studs 212 arranged in a second row proximate a side of the wall panel 700 that faces an exterior of the building. Alternatively, the studs 410/410' and 412/412' discussed with reference to FIGS. 4A-4C, or another suitable type of stud, may be used in place of the studs 210 and/or 212.

Referring still to FIG. 7A, the studs 210 and 212 extend along a length thereof between the top plate 702 and the bottom plate 704. A first end of each of the studs 210 and 212 is fastened to the top plate 702 and a second end of each of the studs 210 and 212 is fastened to the bottom plate 704. Suitable mechanical fasteners, such as for instance nails, screws, gang plates, etc., may be used to attach the studs 210 and 212 to the top and bottom plates 702 and 704. Although not shown in FIG. 7A, the prefabricated wall panel 700 may include framing for openings such as doors and windows.

The prefabricated wall panel 700 further includes various features for aligning and securing the prefabricated wall panel to a floor section or foundation system and/or to adjacent prefabricated wall panels and/or columns of the post-and-beam structure. In some embodiments, bottom plate 704 of the prefabricated wall panel 700 comprises a first portion of a coupling for securing the prefabricated wall panel 700 to a mating second portion of the coupling formed along the floor section, wherein the coupling limits at least lateral movement of the prefabricated wall panel 700 relative to the floor section (i.e., in the x-direction and/or in the y-direction). For instance, the prefabricated wall panel 700 may include a tongue-like or pin-like element 214 along the bottom plate 704, which may be received in a mating groove, track or hole (not illustrated) formed in the floor section. The tongue-like or pin-like element 214 and the groove, track or hole restrict or eliminate lateral movement of the prefabricated wall panel 700, i.e., prevents the bottom of the prefabricated wall panel from sliding inwardly or outwardly when installed as part of a wall of the building. Optionally, adhesive pads or tape, glue, etc. may be disposed between the first and second portions of the coupling to help secure the prefabricated wall panels in place on the floor section. It is to be understood that similar couplings may be formed between the ends of adjacent prefabricated wall panels, with the necessary modifications.

The prefabricated wall panel 700 may additionally include a tongue-like or pin-like element 218 formed along one end thereof, and a groove, track or hole 220 formed along the other end thereof. When in an assembled condition, the tongue-like or pin-like element 218 of one prefabricated wall panel 700 is received within the groove, track or hole 220 of an adjacent prefabricated wall panel 700. The tongue-like or pin-like element 218 and groove, track or hole 220 restrict or eliminate lateral movement of the prefabricated wall panel 700.

The prefabricated wall panel 700 may additionally or alternatively include one or more retention tabs 216 extending from the bottom plate 704, which are received in mating retention slots (not illustrated in FIG. 7A) that are formed in a floor section. During construction of the building, the prefabricated wall panel 700 is placed on the floor section (not illustrated in FIG. 7A) with the retention tabs 216 inserted into an insertion section of the retention slots. The prefabricated wall panel 700 is then slid into a secured condition, in which a distal end of the retention tabs 216 is within a retention portion of the retention slots. In the secured condition, the prefabricated wall panel 700 is substantially prevented from moving in the positive-z-direction.

Figure 7B:
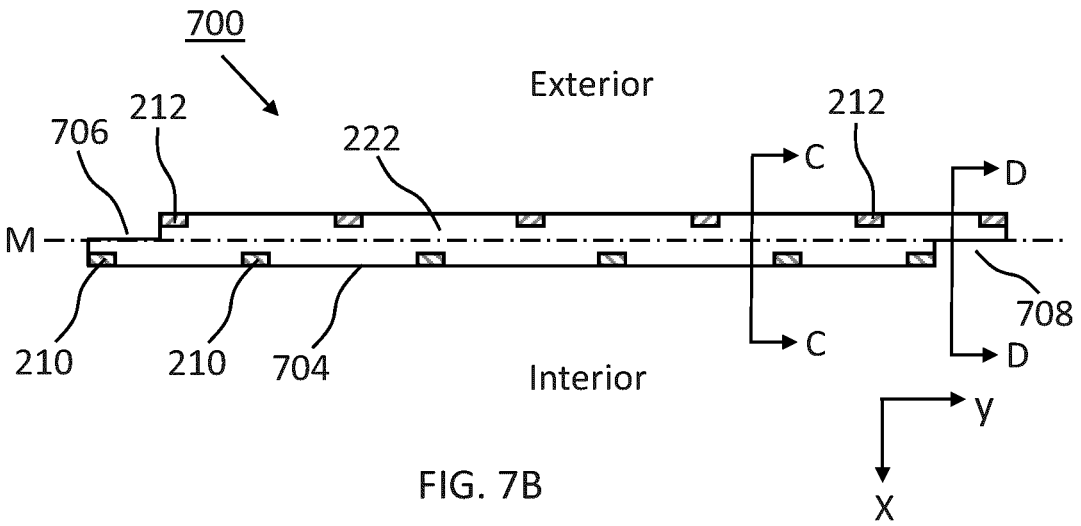
FIG. 7B is a cross-sectional view taken along the line B-B in FIG. 7A.
Figure 7C:
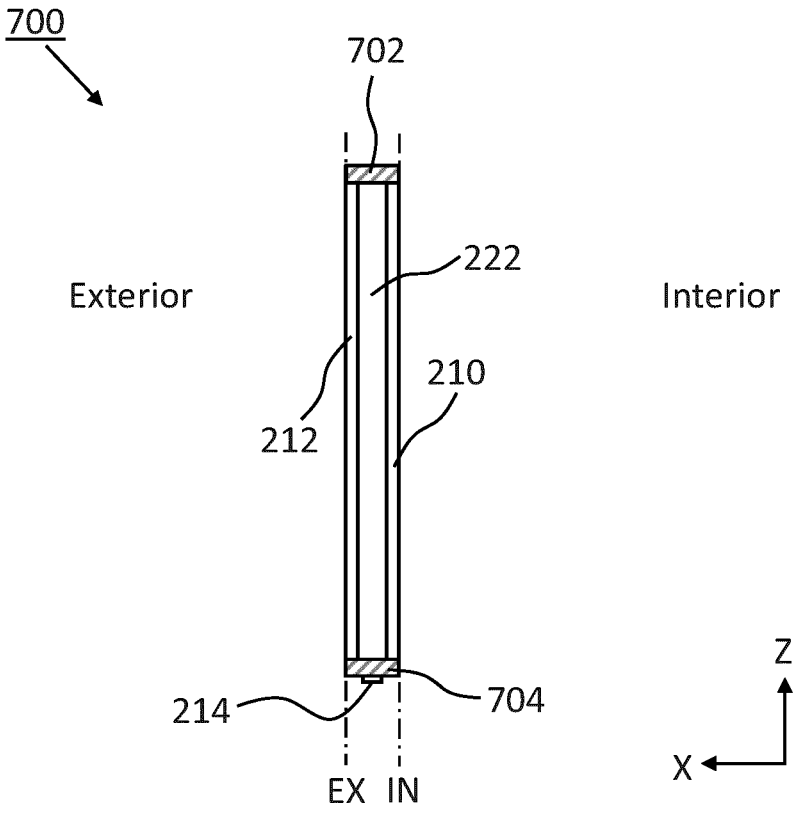
FIG. 7C is a cross-sectional view taken along the line C-C in FIG. 7B.
Figure 7D:
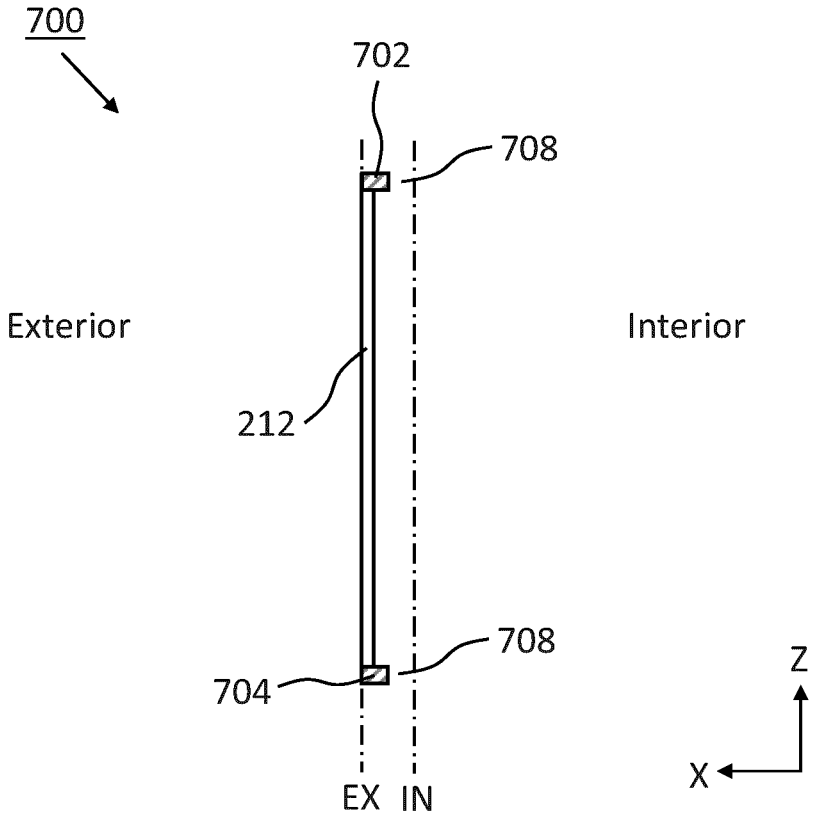
FIG. 7D is a cross-sectional view taken along the line D-D in FIG. 7B.

Referring now to FIG. 7B and also to FIG. 5A, each one of the first studs 210 and each one of the second studs 212 is attached between the top plate 702 and the bottom plate 704 in an orientation in which a widest face 500 of the stud 210 or 212, viewed in a cross-section that is taken in a plane normal to the length of the stud, is parallel to the length direction of the top plate 702 and bottom plate 704. Stated differently, as is shown most clearly in FIG. 7C, the widest face 500 of each stud 210 is substantially flush with a plane IN along the interior side of the prefabricated wall panel 700 and the widest face 500 of each stud 212 is substantially flush with a plane EX along the exterior side of the prefabricated wall panel 700. By rotating the studs 210 and 212 approximately 90° about the length axes thereof, relative to the stud orientation that is shown in prior art FIGS. 1A and 1B, each stud 210 and 212 extends toward the opposite side of the prefabricated wall panel 700 by a minimum amount, which is equal to the dimension of the relatively narrower face 502 of the studs.

Advantageously, the studs 210 and 212 do not become partially interleaved with one another when they are oriented as shown in FIGS. 7A-7D. This allows for insulation of various types to be installed in the space 222 between the studs 210 and 212, without reducing the thermal resistance at the location of the studs, and while maintaining continuous insulation between the top and bottom plates and eliminating or significantly reducing thermal bridging. An improvement of 7% to 20% in thermal resistance may be achieved compared to a prior art wall using the same amount of insulation. In addition, plumbing and/or electrical wires or conduits may be passed through the space 222 between the studs 210 and 212, as required.

As shown most clearly in FIG. 7B, the bottom plate 704 (as well as the not illustrated top plate 702) has a first notch 706 at a first end thereof and a second notch 708 at second end thereof opposite the first end. In the example that is shown in FIG. 7B, the first notch 706 extends from the exterior side of the bottom plate 704 to approximately the mid-line, M, of the bottom plate 704. Similarly, the second notch 708 extends from the interior side of the bottom plate 704 to approximately the mid-line, M, of the bottom plate 704. Of course, the sizes and shapes of the notches 706 and 708 may be different than illustrated in the specific example that is shown in FIG. 7B. Preferably, the top plate 702 is shaped similarly to the bottom plate 704, with a first corresponding first notch 706 at a corresponding first end thereof and a corresponding second notch 708 at a corresponding second end thereof.

When assembled together to form a building, the first notches 706 at the first end of one prefabricated wall panel 700 and the second notches 708 at the second end of an adjacent prefabricated wall panel 700 allow the two prefabricated wall panels 700 to partially overlap along the width dimension thereof. The partial overlap between the adjacent prefabricated wall panels 700 facilitates aligning the surfaces of the interior and exterior sheathing materials, thereby speeding up construction and reducing the need to use highly skilled workers.

Figure 8A:
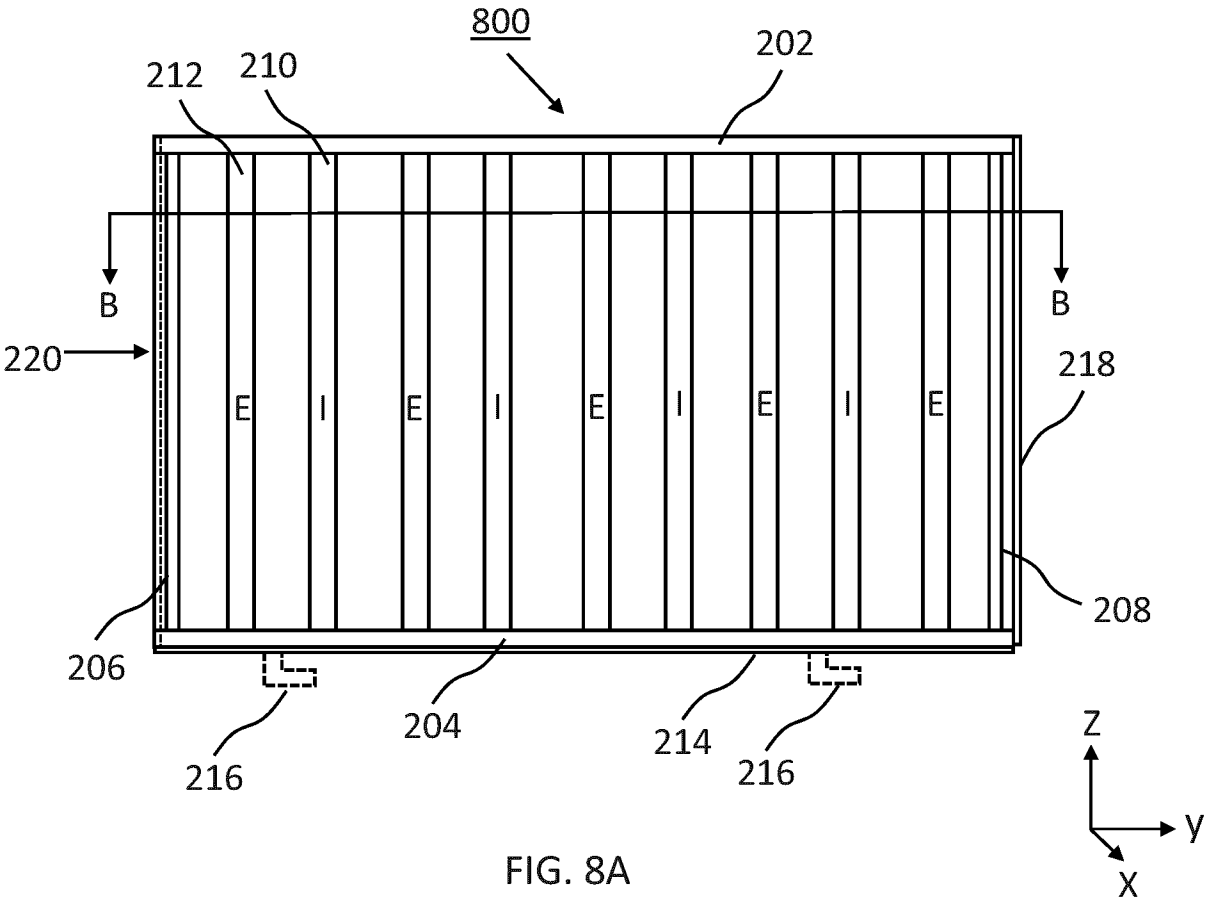
FIG. 8A is a simplified front view showing the internal studs of a prefabricated wall panel according to another embodiment.

FIG. 8A is a front view of a wall panel 800 according to an embodiment, which is shown without interior or exterior wall surfaces attached and without insulation material etc. disposed therein. The wall panel 800 has a frame comprising a horizontal top plate 202, a 15 horizontal bottom plate 204 and first and second opposite vertical end members 206 and 208. The top plate 202 and/or the bottom plate 204 each may be a single plate, or a double plate or a triple plate, etc., and may be fabricated from wood, manufactured wood product, construction grade steel, or another suitable material. The top plate 202 and the bottom plate 204 may be e.g., of a standard size such as for instance a nominal 2×6. The first and second opposite vertical end members 206 and/or 208 may serve as columns in the post-and-beam structural frame of the building. The vertical end members 206 and 208 each may comprise a unitary wooden or metal element or may comprise two or more wooden or metal elements that are laminated together as shown in FIG. 8A. Alternatively, the first and second opposite vertical end members 206 and/or 208 may comprise a single wooden or metal element that closes the ends of the prefabricated wall panel 800 but does not form a part of the structural frame of the building.

The prefabricated wall panel 800 further includes a plurality of studs, disposed within an interior cavity thereof, including first studs 210 arranged in a first row that is proximate a side of the wall panel 800 that faces an interior of the building, and second studs 212 arranged in a second row proximate a side of the wall panel 800 that faces an exterior of the building. The studs 210 and 212 extend along a length thereof between the top plate 202 and the bottom plate 204. A first end of each of the studs 210 and 212 is fastened to the top plate 202 and a second end of each of the studs 210 and 212 is fastened to the bottom plate 204. Suitable mechanical fasteners, such as for instance nails, screws, gang plates, etc., may be used to attach the studs 210 and 212 to the top and bottom plates 202 and 204. Although not shown in FIG. 8A, the prefabricated wall panel may include framing for openings such as doors and windows.

The prefabricated wall panel 800 further includes various features for aligning and securing the prefabricated wall panels to a not illustrated floor section and/or to adjacent prefabricated wall panels and/or columns of the post-and-beam structure. In some embodiments, bottom plate 204 of the prefabricated wall panel 800 comprises a first portion of a coupling for securing the prefabricated wall panel 800 to a mating second portion of the coupling formed along the floor section, wherein the coupling limits at least lateral movement of the prefabricated wall panel 800 relative to the floor section (i.e., in the x-direction and/or in the y-direction). For instance, the prefabricated wall panel 800 may include a tongue-like or pin-like element 214 along the bottom plate 204, which may be received in a mating groove, track or hole (not illustrated) formed in the floor section. The tongue-like or pin-like element 214 and the groove, track or hole restrict or eliminate lateral movement of the prefabricated wall panel 800, i.e., prevents the bottom of the prefabricated wall panel from sliding inwardly or outwardly when installed as part of a wall of the building. Optionally, adhesive pads or tape, glue, etc. may be disposed between the first and second portions of the coupling to help secure the prefabricated wall panels in place on the floor section. It is to be understood that similar couplings may be formed between the ends of adjacent prefabricated wall panels, with the necessary modifications.

The prefabricated wall panel 800 may additionally include a tongue-like or pin-like element 218 formed along one of the opposite end members 208, and a groove, track or hole 220 formed along the other one of the opposite end members 206. When in an assembled condition, the tongue-like or pin-like element 218 of one prefabricated wall panel 800 is received within the groove, track or hole 220 of an adjacent prefabricated wall panel 800. The tongue-like or pin-like element 218 and groove, track or hole 220 restrict or eliminate lateral movement of the prefabricated wall panel 800.

The prefabricated wall panel 800 may additionally or alternatively include one or more retention tabs 216 extending from the bottom plate 204, which are received in mating retention slots (not illustrated in FIG. 8A) that are formed in a floor section. During construction of the building, the prefabricated wall panel is placed on the floor section with the retention tabs 216 inserted into an insertion section of the retention slots. The prefabricated wall panel 800 is then slid into a secured condition, in which a distal end of the retention tabs 216 is within a retention portion of the retention slots. In the secured condition, the prefabricated wall panel 800 is substantially prevented from moving in the positive-z-direction.

Figure 8B:
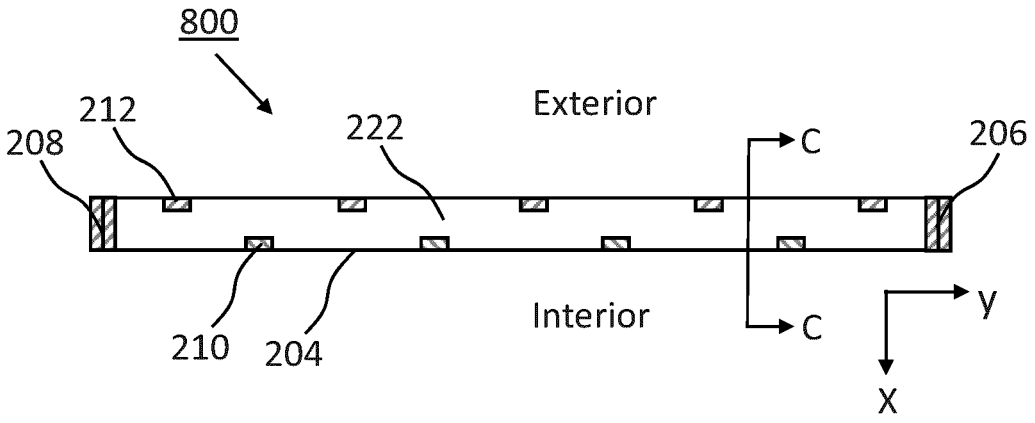
FIG. 8B is a cross-sectional view taken along the line B-B in FIG. 8A.

Referring now to FIG. 8B and also to FIG. 5A, each one of the first studs 210 and each one of the second studs 212 is attached between the top plate 202 and the bottom plate 204 in an orientation in which a widest face 500 of the stud 210 or 212, viewed in a cross-section that is taken in a plane normal to the length of the stud, is parallel to the length direction of the top plate 202 and bottom plate 204. Stated differently, as is shown most clearly in FIG. 8C, the widest face 500 of each stud 210 is substantially flush with a plane IN along the interior side of the prefabricated wall panel 800 and the widest face 500 of each stud 212 is substantially flush with a plane EX along the exterior side of the prefabricated wall panel 800. By rotating the studs 210 and 212 approximately 90° about the length axes thereof, relative to the stud orientation that is shown in prior art FIGS. 1A and 1B, each stud 210 and 212 extends toward the opposite side of the prefabricated wall panel 800 by a minimum amount, which is equal to the dimension of the relatively narrower face 502 of the studs.

Figure 8C:
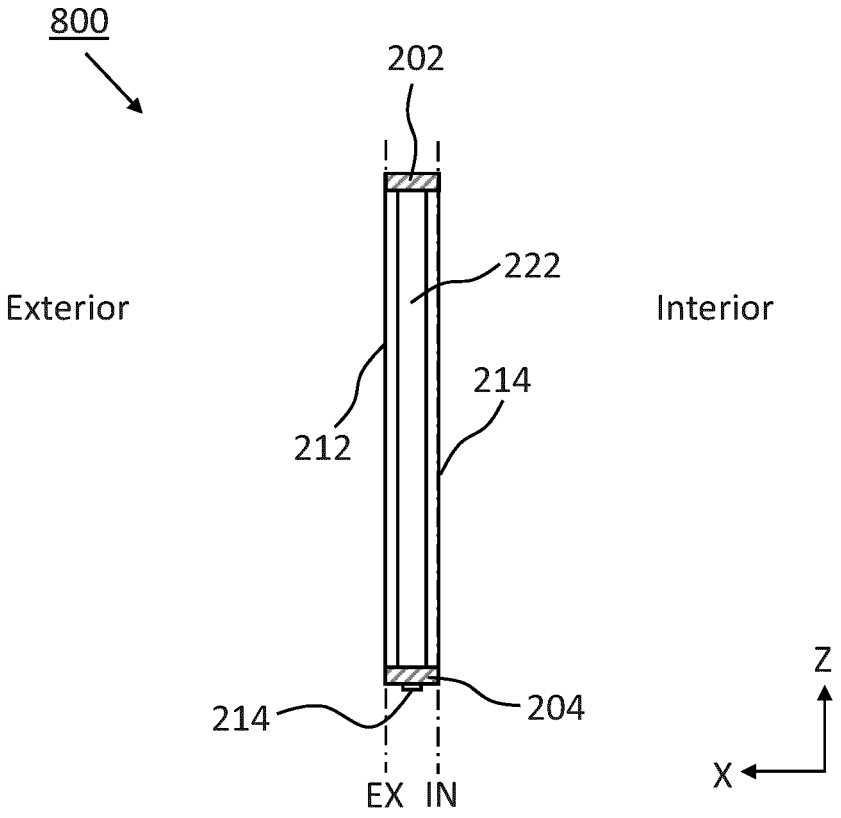
FIG. 8C is a cross-sectional view taken along the line C-C in FIG. 8B.

Advantageously, the studs 210 and 212 do not become partially interleaved with one another when they are oriented as shown in FIGS. 8A-8C. This allows for insulation of various types to be installed in the space 222 between the studs 210 and 212, without reducing the thermal resistance at the location of the studs, and while maintaining continuous insulation between the top and bottom plates and eliminating or significantly reducing thermal bridging. An improvement of 7% to 20% in thermal resistance may be achieved compared to a prior art wall using the same amount of insulation. In addition, plumbing and/or electrical wires or conduits may be passed through the space 222 between the studs 210 and 212, as required.

As was discussed hereinabove, the stud orientation within the prefabricated wall panels of the various embodiments plays an important role in the disclosed construction system. Rotating the studs by up to 90° relative to the studs in the prior art wall reduces or eliminates thermal bridging between panels, which would otherwise occur across a stud that is physically connected to two opposing walls, as is often the case in typical construction. Eliminating thermal bridging is especially important for steel stud frames, since the steel has a high thermal conductivity. The stud orientation also allows for plumbing and/or electrical wires or conduits to be run in between the two rows of studs. The change in stud orientation, relative to the prior art wall, is made possible due to the post-and-beam design, described below with reference to FIG. 9, which eliminates the need for the studs within the prefabricated wall panels to support gravity loads of the building. It is a further advantage that, for lateral loads, the studs in the prefabricated wall panels are oriented in their stronger direction to the lateral loads, making them "stronger" in that direction. Finally, the capacity of the wall to resist the guard loads and localized wind loads (cladding loads) is not compromised in this design.

Figure 9:
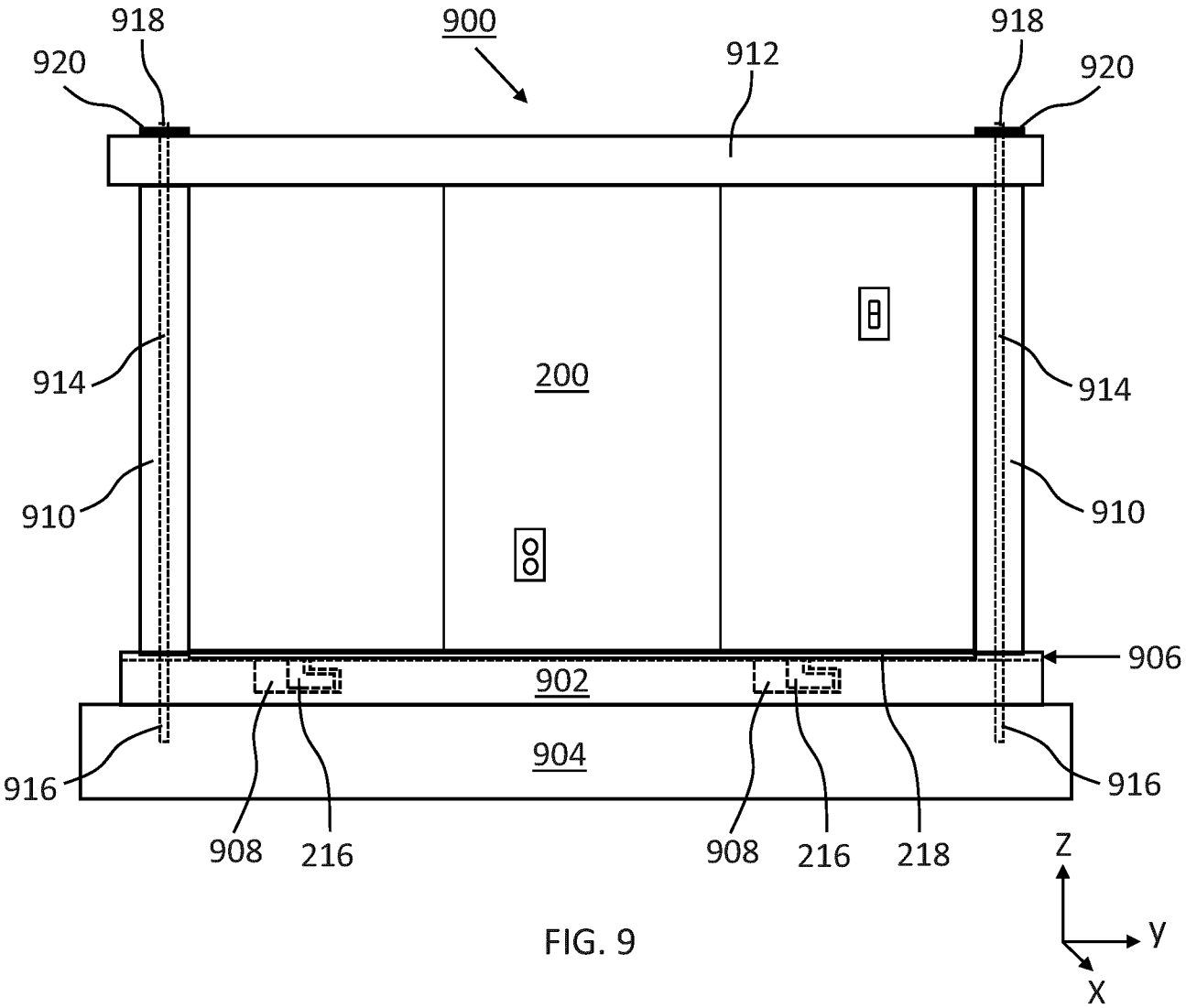
FIG. 9 is a simplified diagram showing the finished wall panel of FIG. 3A forming a portion of an exterior wall in a post-and-beam building.

FIG. 9 is simplified diagram showing a finished prefabricated wall panel (i.e., any of the wall panels 200, 400, 400', 600, 600', 600", 700 or 800 with interior insulation, electrical/plumbing installed as required, interior surface panels such as drywall, and exterior sheathing/insulation/barrier material and finish materials attached, similar to the prefabricated wall panel 200 that is shown in FIGS. 3A-3C) forming a portion of an exterior wall in a post-and-beam frame building 900. For simplicity, reference will be made hereinbelow to the prefabricated wall panel 200, but it is to be understood that wall panels according to any of the various embodiments may be used.

The prefabricated wall panel 200 is disposed on a floor section 902, which is supported on a foundation system 904, such as for instance a poured concrete foundation wall. The tongue-like or pin-like element 218 along the bottom plate 204 is received within a groove, track or hole 906 formed in the floor section 902, which prevents or at least limits lateral movement in the x-direction and/or in the y-direction shown in FIG. 9. In the example that is shown in FIG. 9, the optional retention tabs 216 are received within retention slots 908 formed in the floor section 902, which prevents or at least limits movement in the positive z-direction shown in FIG. 9.

In the example that is shown in FIG. 9, the prefabricated wall panel 200 is disposed between a pair of columns 910. Each column 910 may be a heavy timber post having a circular, square, or rectangular profile. A central hole may be drilled through the post between the upper and lower ends thereof, or a recessed channel may be formed in the outer surface of the post, to create a space for accommodating a rod or cable anchor. Alternatively, each column 910 may be formed by laminating or assembling together two or more pieces of lumber, steel studs, or other material to create a post with a central through-hole or a recess on the side. A steel C-section, a hot rolled steel section (HSS), or other type of column also may be employed in some embodiments. Optionally, the central openings or recesses may be filled with a cementitious material or with a polymer to embed the rod or cable anchors permanently within the columns 910.

In other embodiments, the columns that are 910 shown in FIG. 9 may be omitted and instead the prefabricated wall panel may include integrated columns, such as for instance the first and second opposite vertical end members 206 and 208 in the prefabricated wall panel 800, which form part of the post-and-beam structure of the building. Of course, any combination of columns 910, prefabricated wall panels with integrated columns, and prefabricated wall panels without integrated columns may be used in a building.

Referring still to FIG. 9, a horizontal beam 912 spans between the tops of a pair of columns 910. Of course, the horizontal beam 912 may span across the tops of any desired number of columns 910, depending on the design requirements of the building. The horizontal beam 912 may be e.g., integrated into an upper floor section or may be integrated into a ceiling section. Alternatively, the horizontal beam 912 is a separate element that is not integrated into an upper floor section or a ceiling section. The horizontal beam 912 may be fabricated from wood or a metal such as for instance construction grade steel or may be fabricated from another suitable material. The pair of columns 910 supported on the floor section 902 cooperate with the horizontal beam 912 to surround the prefabricated wall panel 200.

A plurality of rod or cable anchors 914 is arranged to secure the building to the foundation system 904. In the example that is shown in FIG. 9, one end 916 of the rod or cable anchors is set into the concrete of the foundation system 904. Optionally or additionally, anchor bolts and plates may be used to secure the end 916 of the rod or cable anchors to the foundation 904. The rod or cable anchors extend upward through the interior of the pair of columns 910 to a second end 918 above the horizontal beam 912. Locking and tensioning mechanisms 920 are used to add tension to the rod or cable anchors 914, and to maintain the rod or cable anchors 914 under said tension. The plurality of rod or cable anchors 914 cooperate with the locking and tensioning mechanisms 920 to exert a pulling force along a downward direction toward the foundation 904 for opposing an upward lifting force exerted on the portion of the exterior wall of the building shown in FIG. 9. Such lifting forces may occur during windstorms or during earthquakes, etc.

The ability of the assembled wall and floor panels to resist movement in the positive-z-direction (uplift) is established by providing a continuous support from floor to floor or from foundation to roof, which is capable of resisting the required loads. The support connections may be permanent, as discussed above, or it may be possible to remove the connections and thereby disassemble the building if desired. As noted above, there is no access to the bottom plate of the finished prefabricated wall panels and accordingly it is not possible to fasten the prefabricated wall panels to the underlying floor or foundation system, as is typically done in the prior art, using screws or bolts that are placed through the bottom plate. The plurality of rod or cable anchors 914 allows the prefabricated wall panels to be secured in place without having access to the bottom plates thereof, which advantageously makes it possible to fully enclose the prefabricated wall panels with interior and exterior sheathing and finish material, greatly simplifying and speeding up the final construction phase at the building site.

Figure 10:
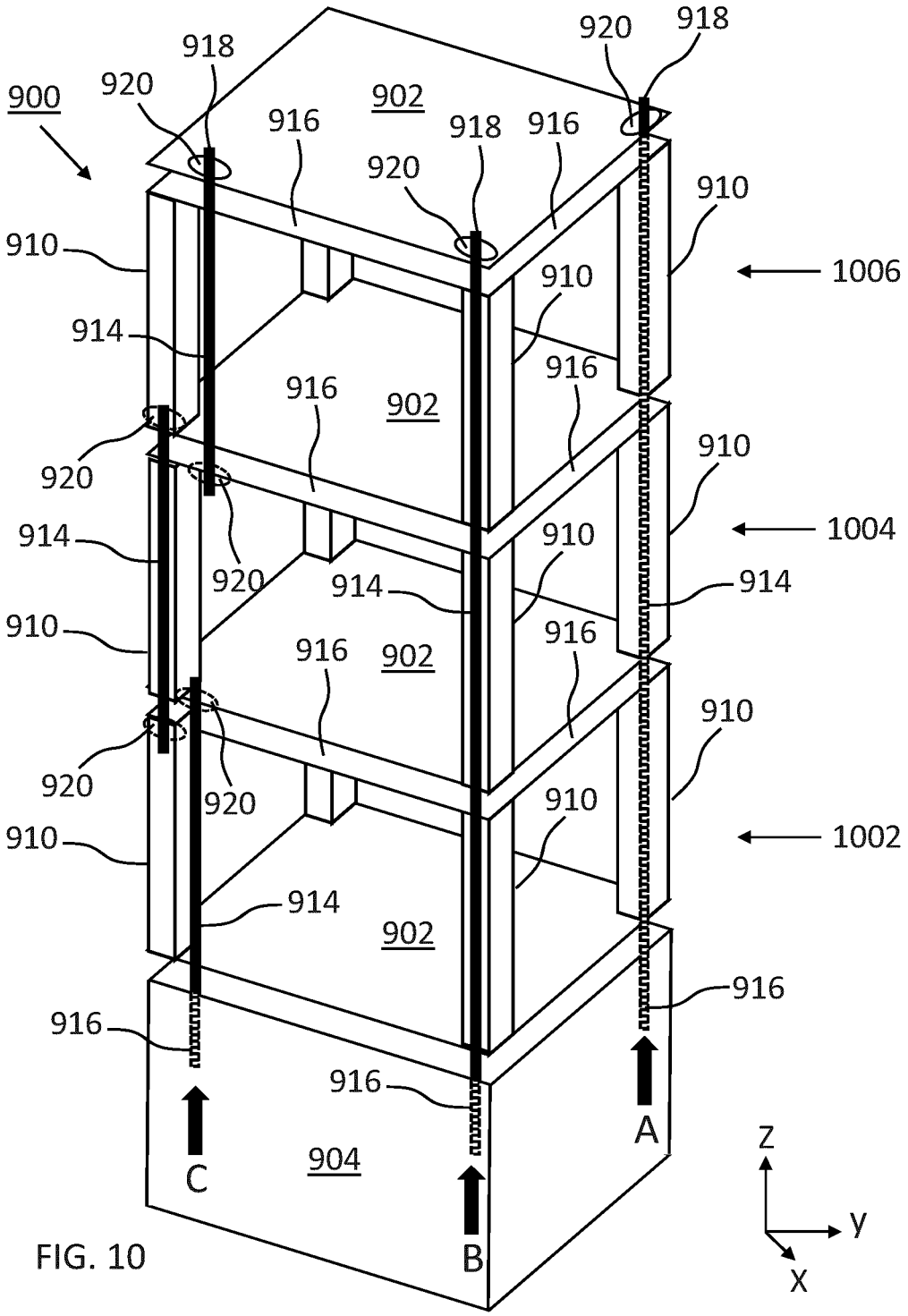
FIG. 10 is a simplified diagram showing a plurality of alternative arrangements for placing cable or rod anchors in a multi-story, post-and-beam building.

Of course, many different arrangements may be envisaged for placing the rod or cable anchors 914 to secure the building to the foundation system 904. FIG. 10 illustrates three preferred arrangements, labeled A, B and C, for placing the cable or rod anchors 714 in a multi-story, post-and-beam building. Other arrangements may be envisaged without departing from the scope of the instant invention.

Option A includes a rod or cable anchor 914 having one end 916 that is embedded in the building foundation 904. The rod or cable anchor 914 extends upwardly through the central openings in a plurality of columns 910 and floor sections 902 and terminates at an opposite end 918, which engages a locking and tensioning mechanism 920. The rod or cable anchor 914 may be secured to an upper surface of the uppermost floor section 902, which includes an integrated horizontal beam that is not illustrated in FIG. 10. The locking and tensioning mechanism 920 adds tension to the rod or cable anchor 914 to exert a pulling force that is transmitted through the plurality of columns 910 so as to oppose lifting forces that are directed along the positive z-direction.

Option B is similar to Option A but the rod or cable anchor 914 is external to the plurality of columns 910. For instance, the rod or cable anchor 914 runs adjacent to an external surface of the columns 910. Alternatively, a not illustrated channel or recess is formed into the external surface of the columns 910 and the rod or cable anchor 914 runs within the not illustrated channel or recess. Similar to option A, the rod or cable anchor 914 terminates at an opposite end 918, which engages a locking and tensioning mechanism 920. The rod or cable anchor 914 may be secured to an upper surface of the uppermost floor section 902, which includes an integrated horizontal beam that is not illustrated in FIG. 10. The locking and tensioning mechanism 920 adds tension to the rod or cable anchor 914 to exert a pulling force that is transmitted through the plurality of columns 910 so as to oppose lifting forces that are directed along the positive z-direction.

Option C also includes a rod or cable anchor 914 having one end 916 that is embedded in the building foundation 904, but the rod or cable anchor 914 only extends to above a floor section 902 that is supported by a set of columns 910 in a first level 1002 of the building 900. Additional assemblies of rod or cable anchors 914 and locking and tensioning mechanisms 920 are used to secure the second level 1004 to the first level 1002, and to secure the third level 1006 to the second level 1004, and so forth.

Figure 11:
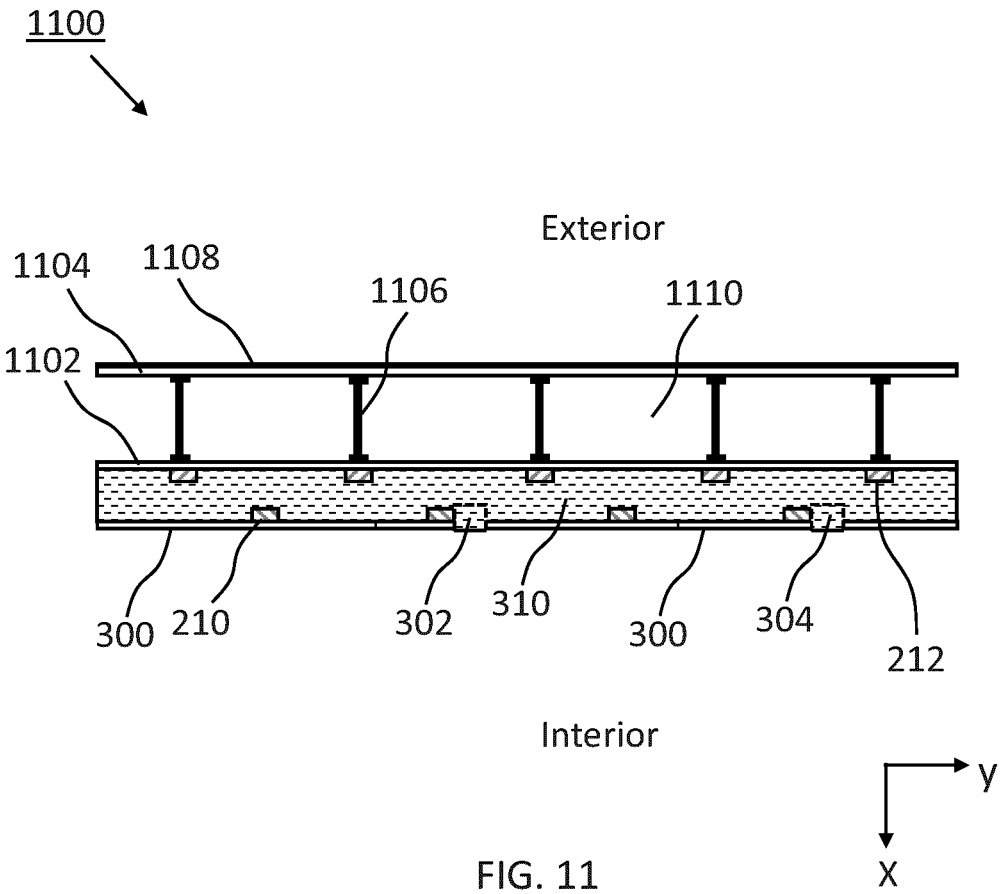
FIG. 11 is a simplified diagram showing a foundation wall panel according to an embodiment.

Referring now to FIG. 11, shown is a simplified diagram of a foundation wall panel according to an embodiment. The foundation wall panel 1100, shown in a cross-sectional top view, may be used for forming walls below grade or partially below grade, either before or after pouring a concrete slab. Advantageously, the foundation wall panel 1100 forms a portion of the foundation system of the building and a portion of a finished interior wall surface, complete with drywall or other suitable wall surface material and optionally paint or wallpaper etc.

The foundation wall panel 1100 includes several components that were discussed above with reference to e.g., the prefabricated wall panel 200, including studs 210 and 212, front panels 300, insulation material 310, electrical outlet 302 and switch 304, etc. However, it is to be understood that a stud configuration similar to that discussed with reference to any of the prefabricated wall panels 200, 400, 400', 600, 600', 600", 700 or 800 may be used.

Referring still to FIG. 11, a first stay-in-place form panel 1102 is attached adjacent to and in contact with the studs 212. A second stay-in-place form panel 1104 is disposed in a spaced apart facing arrangement with the first stay-in-place form panel 1102. Non-limiting examples of suitable materials for the first and second stay-in-place form panels 1102 and 1104 include OSB, plywood, fiber cement board, cementitious boards, or metal sheets. Brackets 1106, such as for instance plastic or metal brackets, are disposed between the first and second stay in place sheathing or cement board panels 1102 and 1104, for maintaining the desired spacing therebetween. Preferably, a waterproofing or dampproofing layer 1108 is applied to the exterior surface of the second stay in place sheathing or cement board panel 1104 to prevent the ingress of surface water. Concrete is poured into the space 1110 between the first and second stay in place sheathing or cement board panels 1102 and 1104. This results in a finished foundation wall when the concrete is cured, and no forms need be removed.

The space 1110 in FIG. 11 is shown with a generally uniform thickness along a width direction of the foundation wall panel 1100, but different geometries may be created by using brackets of different sizes and/or differently shaped first and/or second stay in place sheathing or cement board panels 1102 and 1104. In this way, the resulting concrete foundation wall that is formed within the space 1110 may be thicker in places where a gravity load is transmitted via a column of the post-and-beam structure and may be thinner in places where a load is not being supported. In this way, the amount of concrete used to form the foundation wall may be optimized to provide the necessary structural support at minimal cost while reducing embodied energy. Additionally, or alternatively, the space 1110 may be configured to form corners, circular shapes, etc.

Throughout the description and claims of this specification, the words "comprise", "including", "having" and "contain" and variations of the words, for example "comprising" and "comprises" etc., mean "including but not limited to", and are not intended to, and do not exclude other components.

It will be appreciated that variations to the foregoing embodiments of the disclosure can be made while still falling within the scope of the disclosure. Each feature disclosed in this specification, unless stated otherwise, may be replaced by alternative features serving the same, equivalent or similar purpose. Thus, unless stated otherwise, each feature disclosed is one example only of a generic series of equivalent or similar features.

All of the features disclosed in this specification may be combined in any combination, except combinations where at least some of such features and/or steps are mutually exclusive. In particular, the preferred features of the disclosure are applicable to all aspects of the disclosure and may be used in any combination. Likewise, features described in non-essential combinations may be used separately (not in combination).

What is claimed is:

1. A prefabricated wall panel for use in a construction system for constructing a building, comprising:

a horizontal top plate and a horizontal bottom plate defining a portion of a frame of the prefabricated wall panel;

one or more front panels extending between the top and bottom plates and forming a first wall surface adjacent to a first side of the frame;

one or more back panels extending between the top and bottom plates and forming a second wall surface adjacent to a second side of the frame that is opposite the first side; and a plurality of studs extending along a length direction thereof between the top plate and the bottom plate, wherein the studs are disposed between the one or more front panels and the one or more back panels and are arranged in first and second rows that are offset one relative to the other along a width direction of the wall panel, wherein the studs in the first row are in contact with the one or more front panels but not with the one or more back panels and the studs in the second row are in contact with the one or more back panels but not with the one or more front panels, wherein each stud is oriented such that a widest face thereof, in a cross-section taken in a plane that is normal to the length direction of the stud, is other than normal to a respective one of the one or more front panels or the one or more back panels, and wherein each stud is an irregular pentagonal prism in the cross-section taken in the plane that is normal to the length direction of the stud, and wherein the widest face thereof is other than parallel to the respective one of the one or more front panels or the one or more back panels.

2. The prefabricated wall panel of claim 1, further comprising first and second opposite vertical end members, wherein the top plate, the bottom plate and the first and second opposite vertical end members cooperate to form the frame of the prefabricated wall panel having a perimeter.

3. The prefabricated wall panel of claim 1, comprising insulation material disposed therein between the one or more front panels and the one or more back panels and extending continuously along the width direction of the prefabricated wall panel and along a height direction of the prefabricated wall panel between the top plate and the bottom plate.

4. The prefabricated wall panel as defined in claim 3, comprising at least one of electrical wiring or plumbing tubes pre-installed inside the prefabricated wall panel between the one or more front panels and the one or more back panels.

5. The prefabricated wall panel of claim 3, comprising at least one retention tab formed along the bottom plate of the frame for mating to a complementary retention slot that is formed along a floor of the building.

6. The prefabricated wall panel as defined in claim 3, further comprising a load bearing column of the building integrated therein.

7. A prefabricated wall panel for use in a construction system for constructing a building, comprising:

a horizontal top plate and a horizontal bottom plate defining a portion of a frame of the prefabricated wall panel;

one or more front panels extending between the top and bottom plates and forming a first wall surface adjacent to a first side of the frame;

one or more back panels extending between the top and bottom plates and forming a second wall surface adjacent to a second side of the frame that is opposite the first side;

a plurality of studs extending along a length direction thereof between the top plate and the bottom plate, wherein the studs are disposed between the one or more front panels and the one or more back panels and are arranged in first and second rows that are offset one relative to the other along a width direction of the wall panel, wherein the studs in the first row are in contact with the one or more front panels but not with the one or more back panels and the studs in the second row are in contact with the one or more back panels but not with the one or more front panels, and a plastic bracket extending between and being in contact with one of the studs in the first row and the one or more back panels, or extending between and being in contact with one of the studs in the second row and the one or more front panels, wherein each stud is oriented such that a widest face thereof, in a cross-section taken in a plane that is normal to the length direction of the stud, is other than normal to a respective one of the one or more front panels or the one or more back panels.

8. The prefabricated wall panel of claim 7, further comprising first and second opposite vertical end members, wherein the top plate, the bottom plate and the first and second opposite vertical end members cooperate to form the frame of the prefabricated wall panel having a perimeter.

9. The prefabricated wall panel of claim 7, comprising insulation material disposed therein between the one or more front panels and the one or more back panels and extending continuously along the width direction of the prefabricated wall panel and along a height direction of the prefabricated wall panel between the top plate and the bottom plate.

10. The prefabricated wall panel of claim 7, comprising at least one of electrical wiring or plumbing tubes pre-installed inside the prefabricated wall panel between the one or more front panels and the one or more back panels.

11. The prefabricated wall panel of claim 10, wherein the first wall surface is a portion of a finished interior wall-surface of the building and the second wall surface is a portion of a finished exterior wall-surface of the building.

12. The prefabricated wall panel of claim 11, comprising at least one retention tab formed along the bottom plate of the frame for mating to a complementary retention slot that is formed along a floor of the building.

13. The prefabricated wall panel of claim 11, further comprising a load bearing column of the building integrated therein.

14. A construction system for constructing a building, comprising:

a horizontal beam for supporting a vertical load of the building:

a plurality of columns for supporting the horizontal beam and for transmitting the vertical load to a foundation of the building:

a plurality of rod or cable anchors, each of the anchors having a first end for being coupled to the foundation and having a second end for being coupled to an upper end of one of the columns or to the horizontal beam;

a plurality of locking and tensioning mechanisms, each locking and tensioning mechanism for adding tension to a respective one of the plurality of rod or cable anchors when said anchors are in a coupled condition between the foundation and the upper end of the one of the columns or the horizontal beam, and for maintaining the respective one of the pluralities of rod or cable anchors under said tension; and a prefabricated wall panel having, prior to being incorporated into the building, a covered interior-facing side defining a portion of a finished interior wall-surface of the building and a covered exterior-facing side defining a portion of a finished exterior wall-surface of the building, and the prefabricated wall panel further having at least one of:

i) electrical wiring pre-installed inside the prefabricated wall panel between the covered interior-facing side and the covered exterior-facing side; and ii) plumbing tubes pre-installed inside the prefabricated wall panel between the covered interior-facing side and the covered exterior-facing side;

wherein the prefabricated wall panel, the horizontal beam, and the plurality of columns cooperate to form at least a portion of an exterior wall of the building when the construction system is in an assembled condition, and wherein, in the assembled condition, the plurality of rod or cable anchors cooperate with the plurality of locking and tensioning mechanisms to exert a pulling force along a downward direction toward the foundation for opposing an upward lifting force exerted on the at least a portion of the exterior wall of the building;

wherein at least one retention tab formed along a perimeter thereof for mating to a complementary retention slot formed along at least one of:

i) a floor of the building ii) an exterior surface of one of the columns of the plurality of columns; or iii) the perimeter of another prefabricated wall panel;

wherein the prefabricated wall panel comprises: a horizontal top plate and a horizontal bottom plate defining a portion of a frame of the prefabricated wall panel;

wherein the covered interior-facing side comprises one or more front panels extending between the top and bottom plates and forming the portion of the finished interior wall-surface of the building;

wherein the covered exterior-facing side comprises one or more back panels extending between the top and bottom plates and forming the portion of the finished exterior wall-surface of the building; and a plurality of studs extending along a length direction thereof between the top plate and the bottom plate, wherein the studs are disposed between the one or more front panels and the one or more back panels and are arranged in first and second rows that are offset one relative to the other along a width direction of the prefabricated wall panel, wherein the studs in the first row are in contact with the one or more front panels but not with the one or more back panels and the studs in the second row are in contact with the one or more back panels but not with the one or more front panels, and wherein each stud is oriented such that a widest face thereof, in a cross-section taken in a plane that is normal to the length direction of the stud, is other than normal to a respective one of the one or more front panels or the one or more back panels.

15. The construction system of claim 14, wherein each stud is an irregular pentagonal prism in the cross-section taken in the plane normal to the length direction of the stud, and wherein the widest face thereof is other than parallel to the respective one of the one or more front panels or the one or more back panels.

16. The construction system of claim 14, wherein the prefabricated wall panel comprises insulation material disposed therein between the one or more front panels and the one or more back panels, the insulation material extending continuously along the width direction of the prefabricated wall panel and along a height direction of the wall panel between the top plate and the bottom plate.

* * * * *